US007572362B2

(12) United States Patent
Freel et al.

(10) Patent No.: US 7,572,362 B2
(45) Date of Patent: Aug. 11, 2009

(54) MODIFIED THERMAL PROCESSING OF HEAVY HYDROCARBON FEEDSTOCKS

(75) Inventors: Barry Freel, Greely (CA); Jerry F. Kriz, Ottawa (CA); Doug Clarke, Munster (CA)

(73) Assignee: Ivanhoe Energy, Inc. (CA)

( * ) Notice: Subject to any disclaimer, the term of this patent is extended or adjusted under 35 U.S.C. 154(b) by 201 days.

(21) Appl. No.: 10/419,053

(22) Filed: Apr. 17, 2003

(65) Prior Publication Data

US 2004/0069682 A1 Apr. 15, 2004

Related U.S. Application Data

(63) Continuation-in-part of application No. 10/269,538, filed on Oct. 11, 2002.

(51) Int. Cl.
*C10G 9/28* (2006.01)
*C10G 9/26* (2006.01)

(52) U.S. Cl. ..... 208/126; 208/14; 208/22; 208/73; 208/75; 208/91; 208/113; 208/127; 208/226; 208/251 R; 208/299; 208/307; 208/419; 208/420; 106/273.1

(58) Field of Classification Search ..... 208/106, 208/126, 125, 14, 22, 73, 75, 91, 113, 127, 208/153, 226, 251 R, 299, 307, 419, 420; 106/273.1
See application file for complete search history.

(56) References Cited

U.S. PATENT DOCUMENTS 2,573,906 A 11/1951 Huff (Continued)

FOREIGN PATENT DOCUMENTS

CA 932686 8/1973

(Continued)

OTHER PUBLICATIONS

European Search Report filed in corresponding Application No. EP 03 25 6393, dated Apr. 7, 2004.

(Continued)

*Primary Examiner*—Glenn Caldarola
*Assistant Examiner*—Prem C. Singh
(74) *Attorney, Agent, or Firm*—Orrick, Herrington & Sutcliffe LLP

(57) ABSTRACT

The present invention is directed to the upgrading of heavy petroleum oils of high viscosity and low API gravity that are typically not suitable for pipelining without the use of diluents. It utilizes a short residence-time pyrolytic reactor operating under conditions that result in a rapid pyrolytic distillation with coke formation. Both physical and chemical changes taking place lead to an overall molecular weight reduction in the liquid product and rejection of certain components with the byproduct coke. The liquid product is upgraded primarily because of its substantially reduced viscosity, increased API gravity, and the content of middle and light distillate fractions. While maximizing the overall liquid yield, the improvements in viscosity and API gravity can render the liquid product suitable for pipelining without the use of diluents. This invention particularly relates to reducing sulfur emissions during the combustion of byproduct coke (or coke and gas), to reducing the total acid number (TAN) of the liquid product, and to reducing the hydrogen sulfide content of one, or more than one component of the product stream. The method comprises introducing a particulate heat carrier into an up-flow reactor, introducing the feedstock at a location above the entry of the particulate heat carrier, allowing the heavy hydrocarbon feedstock to interact with the heat carrier for a short time, separating the vapors of the product stream from the particulate heat carrier and liquid and byproduct solid matter, regenerating the particulate heat carrier in the presence of the calcium compound, and collecting a gaseous and liquid product from the product stream.

55 Claims, 8 Drawing Sheets

U.S. PATENT DOCUMENTS

| | | | | | |
|---|---|---|---|---|---|
| 2,735,804 | A | | 2/1956 | Boston et al. | |
| 3,039,955 | A | | 6/1962 | Honnold | |
| 3,853,498 | A | | 12/1974 | Bailie | |
| 3,915,844 | A | * | 10/1975 | Ueda et al. | 208/127 |
| 4,039,390 | A | | 8/1977 | Logan | |
| 4,054,492 | A | | 10/1977 | Rammler et al. | |
| 4,057,490 | A | * | 11/1977 | Wynne, Jr. | 208/127 |
| 4,064,018 | A | | 12/1977 | Choi | |
| 4,080,285 | A | | 3/1978 | McKinney et al. | |
| 4,083,751 | A | | 4/1978 | Choi | |
| 4,085,030 | A | | 4/1978 | Green et al. | |
| 4,087,347 | A | | 5/1978 | Langois et al. | |
| 4,097,362 | A | * | 6/1978 | McKinney et al. | 208/78 |
| 4,102,773 | A | | 7/1978 | Green et al. | |
| 4,106,999 | A | | 8/1978 | Koppelman et al. | |
| 4,108,732 | A | | 8/1978 | Nuttall, Jr. | |
| 4,141,794 | A | | 2/1979 | Choi | |
| 4,147,593 | A | | 4/1979 | Frischmuth et al. | |
| 4,153,514 | A | | 5/1979 | Garrett et al. | |
| 4,161,442 | A | | 7/1979 | Audeh et al. | |
| 4,211,606 | A | | 7/1980 | Ponomarev et al. | |
| 4,232,514 | A | | 11/1980 | Flatt | |
| 4,243,514 | A | * | 1/1981 | Bartholic | 208/91 |
| 4,252,634 | A | | 2/1981 | Khulbe et al. | |
| 4,260,456 | A | | 4/1981 | Schulman | |
| 4,263,128 | A | | 4/1981 | Bartholic | |
| 4,280,876 | A | | 7/1981 | Green | |
| 4,294,686 | A | | 10/1981 | Fisher et al. | |
| 4,298,453 | A | | 11/1981 | Schoennagel et al. | |
| 4,305,809 | A | | 12/1981 | Chen et al. | |
| 4,311,580 | A | | 1/1982 | Bartholic | |
| 4,322,222 | A | | 3/1982 | Sass | |
| 4,325,817 | A | | 4/1982 | Bartholic et al. | |
| 4,328,091 | A | | 5/1982 | Bartholic | |
| 4,409,416 | A | | 10/1983 | Snell et al. | |
| 4,427,538 | A | | 1/1984 | Bartholic | |
| 4,427,539 | A | | 1/1984 | Busch et al. | |
| 4,435,272 | A | | 3/1984 | Bartholic et al. | |
| 4,448,589 | A | | 5/1984 | Fan et al. | |
| 4,490,243 | A | | 12/1984 | Miyauchi et al. | |
| 4,507,195 | A | | 3/1985 | Spars et al. | |
| 4,569,753 | A | | 2/1986 | Busch et al. | |
| 4,578,183 | A | | 3/1986 | Chou et al. | |
| 4,604,268 | A | | 8/1986 | Kay et al. | |
| 4,661,240 | A | | 4/1987 | Kessick et al. | |
| 4,668,378 | A | | 5/1987 | Miyauchi et al. | |
| 4,693,808 | A | | 9/1987 | Dewitz | |
| 4,747,938 | A | * | 5/1988 | Khan | 208/419 |
| 4,772,378 | A | | 9/1988 | Miyauchi et al. | |
| 4,814,067 | A | | 3/1989 | Gartside et al. | |
| 4,816,136 | A | | 3/1989 | Allan et al. | |
| 4,818,373 | A | | 4/1989 | Bartholic et al. | |
| 4,828,681 | A | | 5/1989 | Yourtee et al. | |
| 4,861,458 | A | * | 8/1989 | Martin et al. | 208/73 |
| 4,919,898 | A | | 4/1990 | Gartside et al. | |
| 4,980,045 | A | | 12/1990 | Krishna et al. | |
| 4,985,136 | A | | 1/1991 | Bartholic | |
| 5,077,261 | A | | 12/1991 | Schubert | |
| 5,092,984 | A | | 3/1992 | Babu et al. | |
| 5,102,854 | A | | 4/1992 | Delzer et al. | |
| 5,136,117 | A | | 8/1992 | Paisley et al. | |
| 5,264,623 | A | | 11/1993 | Oehr et al. | |
| 5,296,131 | A | | 3/1994 | Raterman | |
| 5,310,717 | A | | 5/1994 | Delzer et al. | |
| 5,326,919 | A | | 7/1994 | Paisley et al. | |
| 5,370,789 | A | | 12/1994 | Milne et al. | |
| 5,413,702 | A | | 5/1995 | Yan | |
| 5,662,868 | A | | 9/1997 | Letzsch et al. | |
| 5,723,040 | A | | 3/1998 | Letzsch et al. | |
| 5,792,340 | A | | 8/1998 | Freel et al. | |
| 5,820,750 | A | | 10/1998 | Blum et al. | |
| 5,904,839 | A | | 5/1999 | Brons | |
| 5,928,501 | A | * | 7/1999 | Sudhakar et al. | 208/263 |
| 2002/0100711 | A1 | | 8/2002 | Freel et al. | |
| 2004/0069686 | A1 | * | 4/2004 | Freel et al. | 208/226 |

FOREIGN PATENT DOCUMENTS

| | | | |
|---|---|---|---|
| CA | 1050736 | | 3/1979 |
| CA | 1090732 | | 12/1980 |
| CA | 1108545 | | 9/1981 |
| CA | 1283880 | | 5/1991 |
| DE | 38 28 633 | A1 | 3/1989 |
| EP | 0 072 873 | B1 | 2/1986 |
| EP | 0 513 051 | B1 | 12/1994 |
| GB | 2 117 394 | A | 10/1983 |
| WO | WO 91/11499 | | 8/1991 |
| WO | WO 97/31083 | | 8/1997 |
| WO | WO 02/33029 | A1 | 4/2002 |

OTHER PUBLICATIONS

Textbook Excerpts, "Occidental Flash Pyrolysis," pp. 285-286; "Rockwell Flash Pyrolysis," pp. 285-287.

G. R. Gavalas, "Coal Pyrolysis," Coal Science and Technology 4, pp. 70-76 (1982).

C. L. Oberg et al., "Coal Liquefaction by Flash Hydropyrloysis," Coal Processing Technology 6, pp. 159-165 (1980,California).

D. A. Berg et al., "Characterization of Solids Mixing in an Ultra-Rapid Fluidized Reactor," Power and Bulk Solids Conference (1986, Illinois).

D. A. Berg et al., "Rapid Mixing Studies Between Transported Solids in an Ultra-Rapid Fluidized Reactor," Power and Bulk Solids Conference (1985, Illinois).

J. J. Fritz et al., "Status Review of Wood Biomass: Gasification, Pyrolysis, and Densification Technologies," pp. 66-67 (Jan. 1979).

Symposium Papers Excerpt, "Energy from Biomass and Wastes IV," pp. 1, 25 (Jan. 1980, Florida).

Symposium Papers Excerpt, "Energy from Biomass and Wastes V," pp. 1, 41 (Jan. 1981, Florida).

B. H. Levelton et al., "An Evaluation of Wood Waste Energy Conversion Systems," Enfor Project No. C-111, pp. 5-62 (Dec. 1980, Vancouver, B.C.).

A. Serper, "Resource Recovery Field Stands Poised Between Problems, Solutions," Solid Wastes Management Journal, pp. 16, 86 (May 1980).

N. W. Sorbo et al., "Technical and Economic Feasibility of Small Scale Co-Gasification of Densified Sludge and Solid Waste," Symposium Papers Excerpt, Energy from Biomass and Wastes VI, pp. 587, 596, 628 (Jan. 1982, Florida).

S. T. DiNovo et al., "Preliminary Assessment of Biomass Conversion to Snythetic Fuels," Contract No. 68-02-1323, Industrial Environmental Research Laboratory, pp. 123, 125-127 (Oct. 1978, Ohio).

G. T. Preston, "Resource Recovery and Flash Pyrolysis of Municipal Refuse," Institute of Gas Technology Symposium, pp. 1-28 (Jan. 1976, Florida).

* cited by examiner

MODIFIED THERMAL PROCESSING OF HEAVY HYDROCARBON FEEDSTOCKS

This application is a continuation-in-part of U.S. patent application Ser. No. 10/269,538, filed Oct. 11, 2002, which is hereby incorporated by reference.

The present invention relates to rapid thermal processing (RTP™) of a viscous oil feedstock. More specifically, the present invention relates to a method of reducing the hydrogen sulfide content of one, or more than one gas component of a product stream derived from rapid thermal processing of a heavy hydrocarbon feedstock.

BACKGROUND OF THE INVENTION

Heavy oil and bitumen resources are supplementing the decline in the production of conventional light and medium crude oils, and production from these resources is steadily increasing. Pipelines cannot handle these crude oils unless diluents are added to decrease their viscosity and specific gravity to pipeline specifications. Alternatively, desirable properties are achieved by primary upgrading. However, diluted crudes or upgraded synthetic crudes are significantly different from conventional crude oils. As a result, bitumen blends or synthetic crudes are not easily processed in conventional fluid catalytic cracking refineries. Therefore, in either case further processing must be done in refineries configured to handle either diluted or upgraded feedstocks.

Many heavy hydrocarbon feedstocks are also characterized as comprising significant amounts of BS&W (bottom sediment and water). Such feedstocks are not suitable for transportation by pipeline, or refining due to their corrosive properties and the presence of sand and water. Typically, feedstocks characterized as having less than 0.5 wt.% BS&W are transportable by pipeline, and those comprising greater amounts of BS&W require some degree of processing or treatment to reduce the BS&W content prior to transport. Such processing may include storage to let the water and particulates settle, and heat treatment to drive off water and other components. However, these manipulations add to operating cost. There is therefore a need within the art for an efficient method of upgrading feedstock having a significant BS&W content prior to transport or further processing of the feedstock.

Heavy oils and bitumens can be upgraded using a range of processes including thermal (e.g. U.S. Pat. Nos. 4,490,234; 4,294,686; 4,161,442), hydrocracking (U.S. Pat. No. 4,252,634), visbreaking (U.S. Pat. Nos. 4,427,539; 4,569,753; 5,413,702), or catalytic cracking (U.S. Pat. Nos. 5,723,040; 5,662,868; 5,296,131; 4,985,136; 4,772,378; 4,668,378, 4,578,183) procedures. Several of these processes, such as visbreaking or catalytic cracking, utilize either inert or catalytic particulate contact materials within upflow or downflow reactors. Catalytic contact materials are for the most part zeolite based (see for example U.S. Pat. Nos. 5,723,040; 5,662,868; 5,296,131; 4,985,136; 4,772,378; 4,668,378, 4,578,183; 4,435,272; 4,263,128), while visbreaking typically utilizes inert contact material (e.g. U.S. Pat. Nos. 4,427,539; 4,569,753), carbonaceous solids (e.g. U.S. Pat. No. 5,413,702), or inert kaolin solids (e.g. U.S. Pat. No. 4,569,753).

The use of fluid catalytic cracking (FCC), or other units for the direct processing of bitumen feedstocks is known in the art. However, many compounds present within the crude feedstocks interfere with these processes by depositing on the contact material itself. These feedstock contaminants include metals such as vanadium and nickel, coke precursors such as (Conradson) carbon residues, and asphaltenes. Unless removed by combustion in a regenerator, deposits of these materials can result in poisoning and the need for premature replacement of the contact material. This is especially true for contact material employed with FCC processes, as efficient cracking and proper temperature control of the process requires contact materials comprising little or no combustible deposit materials or metals that interfere with the catalytic process.

To reduce contamination of the catalytic material within catalytic cracking units, pretreatment of the feedstock via visbreaking (U.S. Pat. Nos. 5,413,702; 4,569,753; 4,427,539), thermal (U.S. Pat. Nos. 4,252,634; 4,161,442) or other processes, typically using FCC-like reactors, operating at temperatures below that required for cracking the feedstock (e.g U.S. Pat. Nos. 4,980,045; 4,818,373 and 4,263,128;) have been suggested. These systems operate in series with FCC units and function as pre-treaters for FCC. These pretreatment processes are designed to remove contaminant materials from the feedstock, and operate under conditions that mitigate any cracking. These processes ensure that any upgrading and controlled cracking of the feedstock takes place within the FCC reactor under optimal conditions.

Several of these processes (e.g. U.S. Pat. Nos. 4,818,373; 4,427,539; 4,311,580; 4,232,514; 4,263,128) have been specifically adapted to process "resids" (i.e. feedstocks produced from the fractional distillation of a whole crude oil) and bottom fractions, in order to optimize recovery from the initial feedstock supply. The disclosed processes for the recovery of resids, or bottom fractions, are physical and involve selective vaporization or fractional distillation of the feedstock with minimal or no chemical change of the feedstock. These processes are also combined with metal removal and provide feedstocks suitable for FCC processing. The selective vaporization of the resid takes place under non-cracking conditions, without any reduction in the viscosity of the feedstock components, and ensures that cracking occurs within an FCC reactor under controlled conditions. None of these approaches disclose the upgrading of feedstock within this pretreatment (i.e. metals and coke removal) process. Other processes for the thermal treatment of feedstocks involve hydrogen addition (hydrotreating), which results in some chemical change in the feedstock.

U.S. Pat. No. 4,294,686 discloses a steam distillation process in the presence of hydrogen for the pretreatment of feedstock for FCC processing. This document also indicates that this process may also be used to reduce the viscosity of the feedstock such that the feedstock may be suitable for transport within a pipeline. However, the use of short residence time reactors to produce a transportable feedstock is not disclosed.

During processing of heavy hydrocarbon oil, sulfur is evolved and becomes a component of the flue gas, requiring removal using appropriate scrubbers. U.S. Pat. Nos. 4,325,817, 4,263,128 describe the use of varied catalysts for absorbing $SO_x$ in the oxidizing environment of a regenerator. The catalyst is then transferred to the reducing environment of the reactor where the sulfur is converted to hydrogen sulfide which is then removed from the flue gas using scrubbers. A similar process is disclosed in U.S. Pat. No. 4,980,045, where a reactive alumina catalyst (preferably gamma alumina) is used as the particulate solid, or as a component of the particulate solid within a heavy oil pretreatment process. The reactive alumina is used to absorb gaseous sulfur compounds in flue gasses in the presence of oxygen. U.S. Pat. No. 4,604,268, teaches the removal of hydrogen sulfide within gasses using cerium oxide.

Alternate processes for removal of sulfur from a fluid stream include using zinc oxide silica and a fluorine containing compound as taught in U.S. Pat. No. 5,077,261, or metal silicates as in U.S. Pat. No. 5,102,854, zinc oxide, silica and molybdenum disulfide (U.S. Pat. No. 5,310,717). U.S. Pat. No. 4,661,240 disclose the decreasing of sulfur emissions during coking using calcium.

The present invention is directed to a method for upgrading heavy hydrocarbon feedstocks, for example but not limited to heavy oil or bitumen feedstocks, which utilizes a short residence-time pyrolytic reactor operating under conditions that upgrade the feedstock by cracking and coking reactions. The feedstock used within this process may comprise significant levels of BS&W and still be effectively processed, thereby increasing the efficiency of feedstock handling. The process of the present invention provides for the preparation of a partially upgraded feedstock exhibiting reduced viscosity and increased API gravity. The process described herein selectively removes metals, salts, water, and carbonaceous material referred to as asphaltenes. The process maximizes the liquid yield by minimizing coke and gas production. Furthermore, the liquid product produced by the method of the present invention displays a reduced total acid number (TAN) relative to that of unprocessed hydrocarbon feedstock. The present invention also provides a method for reducing the content of sulfur containing gasses evolved during the course of processing a feedstock.

By reducing the TAN of the product, heavy oil feedstocks having a high TAN, and that otherwise command a reduced market value due to their corrosive properties, command higher market value since they can readily be further processed using known upgrading systems, for example FCC or other catalytic cracking procedures, visbreaking, or hydrocracking and the like. High TAN oils usually contain high levels of naphthenic acids that require dilution prior to processing or refining.

The present invention further provides a method of reducing the hydrogen sulfide content of one, or more than one gas component of a product stream derived from rapid thermal processing of a feedstock oil.

It is an object of the invention to overcome disadvantages of the prior art.

The above object is met by the combinations of features of the main claims, the sub-claims disclose further advantageous embodiments of the invention.

SUMMARY OF THE INVENTION

The present invention relates to rapid thermal processing (RTP™) of a viscous oil feedstock. More specifically, the present invention relates to a method of reducing the hydrogen sulfide content of one, or more than one gas component of a product stream derived from rapid thermal processing of a heavy hydrocarbon feedstock.

The present invention provides a method of reducing the hydrogen sulfide content of one, or more than one component of a product stream derived from rapid thermal processing of a heavy hydrocarbon feedstock, comprising:

(i) rapid thermal processing of the heavy hydrocarbon feedstock in the presence of a calcium compound;

(ii) rapid thermal processing of the heavy hydrocarbon feedstock in the presence of a calcium compound, and regeneration of a particulate heat carrier in a reheater in the presence of a calcium compound, or (iii) rapid thermal processing of the heavy hydrocarbon feedstock, and regeneration of a particulate heat carrier in a reheater in the presence of a calcium compound.

In a preferred embodiment, the step of rapid thermal processing comprises allowing the heavy hydrocarbon feedstock to interact with a particulate heat carrier in a reactor for less than about 5 seconds, to produce a product stream, wherein the ratio of the particulate heat carrier to the heavy hydrocarbon feedstock is from about 10:1 to about 200:1.

In another embodiment, the method of the present invention further comprises a step of removing a mixture comprising the product stream and the particulate heat carrier from the reactor.

In a further embodiment, the method of the present invention further comprises a step of separating the product stream and the particulate heat carrier from the mixture.

In another embodiment, the method of the present invention further comprises a step of regenerating the particulate heat carrier in a reheater. In a preferred embodiment, the reheater temperature is in the range from about 600 to about 900° C., preferably from about 600 to about 815° C., more preferably from about 700 to about 800° C.

In a further embodiment, the method of the present invention further comprises a step of collecting a distillate product and a bottoms product from the product stream.

The present invention is also directed to the method as described above, wherein the bottoms product is subjected to a further step of rapid thermal processing, comprising allowing the liquid product to interact with a particulate heat carrier in a reactor for less than about 5 seconds, wherein the ratio of the particulate heat carrier to the heavy hydrocarbon feedstock is from about 10:1 to about 200:1, to produce a product stream.

In the above-described methods, the calcium compound is added in an amount that is from about 0.2 to about 5 times the stoichiometric amount of sulfur entering the reactor of the system. Preferably, the amount of the calcium compound added is from about at 1.7 to 2 times the stoichiometric amount of sulfur content in byproduct coke and gas.

The calcium compound may be added to the heavy hydrocarbon feedstock before entry of the feedstock into the upflow reactor, or a fractionation column, prior to entry to the upflow reator. Furthermore, the calcium compound may be added to a sand reheater, or the calcium compound may be added to the sand reheater and to the heavy hydrocarbon feedstock.

In an embodiment of the present invention, prior to the step of rapid thermal processing, the feedstock is introduced into a fractionation column that separates a volatile component of the feedstock from a liquid component of the feedstock. The gaseous component is collected, and the liquid component is subjected to rapid thermal processing as described above. In another embodiment, the feedstock is combined with the calcium compound before being introduced into the fractionation column.

The present invention also provides a method of upgrading a heavy hydrocarbon feedstock, comprising:

(i) rapid thermal processing of the heavy hydrocarbon feedstock in the presence of a calcium compound;

(ii) rapid thermal processing of the heavy hydrocarbon feedstock in the presence of a calcium compound, and regeneration of a particulate heat carrier in a reheater in the presence of a calcium compound, or (iii) rapid thermal processing of the heavy hydrocarbon feedstock, and regeneration of a particulate heat carrier in a reheater in the presence of a calcium compound.

The present invention also provides the methods as described above, wherein the calcium compound is selected from the group consisting of calcium acetate, calcium formate, calcium proprionate, a calcium salt-containing bio-oil composition (as described, for example, in U.S. Pat. No.

5,264,623, the disclosure of which is incorporated herein by reference), a calcium salt isolated from a calcium salt-containing bio-oil composition, $Ca(OH)_2$ [$CaO.H_2O$], $CaCO_3$, lime [CaO], and a mixture thereof. The calcium compound can be used in conjunction with a magnesium compound selected from the group consisting of MgO, $Mg(OH)_2$ and $MgCO_3$. The calcium compound can be combined with the feedstock and 0-5% (wt/wt) water. In an embodiment of the method of the present invention, the water is in the form of steam.

The present invention addresses the need within the art for a rapid upgrading process of a heavy oil or bitumen feedstock involving a partial chemical upgrade or mild cracking of the feedstock, while at the same time reducing $H_2S$ content of the gaseous product stream. A range of heavy hydrocarbon feedstocks including feedstocks comprising significant amounts of BS&W may be processed by the methods as described herein, while reducing the amount of $SO_x$ (or any gaseous sulfur species) emissions produced in the flue gas, as well as the hydrogen sulfide content of one, or more than one gas component in the product stream. The product produced by the method of the present invention also displays a reduced total acid number (TAN) relative to the starting (unprocessed) feedstock. As a result, the product produced by the present invention has reduced corrosive properties and is transportable for further processing and upgrading. The present invention is therefore suitable for processing high TAN crude oils such as Marlim from Brazil; Kuito from Angola; Heidrun, Troll, Balder, Alba, and Gryhpon from the North Sea.

The processes as described herein also reduce the levels of contaminants within feedstocks, thereby mitigating contamination of catalytic contact materials such as those used in cracking or hydrocracking, with components present in the heavy oil or bitumen feedstock. The calcium compound used in the method of the present invention may not be directly used with cracking catalysts (such as those used in FCC), as it interacts unfavourably by changing the surface acidity of the catalysts, for example amorphous alumina, alumina-silica or crystalline (zeolite) alumina-silica catalysts, used in these systems. However, calcium is readily removed from the product stream during rapid thermal processing and the calcium content of the product is low.

The processes described herein may be used to process a variety of different feedstocks so that a desired product is produced. For example, feedstocks characterized as having high TAN, and low sulfur content may be processed by adding a calcium compound in the feedstock prior to processing. In doing so, the TAN of the product is reduced, as well as the hydrogen sulfide content of one, or more gas components of the product stream. Alternatively, feedstocks exhibiting a high sulfur content but a low TAN, may not require the addition of a calcium compound to the feedstock (since the TAN is already reduced), but in order to reduce sulfur emissions during regeneration of the heat carrier, as well as the hydrogen sulfide content of one, or more than one gas component of the product stream, a calcium compound may be added to the sand reheater, to the feedstock, or to both. Similarly, a feedstock characterized as having high TAN and high sulfur content may be processed by adding a calcium compound to both the feedstock and the sand reheater, thereby reducing TAN in the product, reducing $SO_x$ emissions in the flue gasses evolving from the sand reheater, and reducing the hydrogen sulfide content of one, or more than one gas component of the product stream.

The gas components having a reduced hydrogen sulfide content do not require any appreciable cleaning or conditioning and are, therefore, useful in post processing combustion systems, for example, in a steam boiler or a thermal combustion system. Alternatively, the gas components having a reduced hydrogen sulfide content can be recycled for use in the rapid thermal pyrolysis reactor, or can be collected and stored for future use. The gas components having a reduced hydrogen sulfide content are particularly useful in remote areas, where systems for cleaning and conditioning gas are not available.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
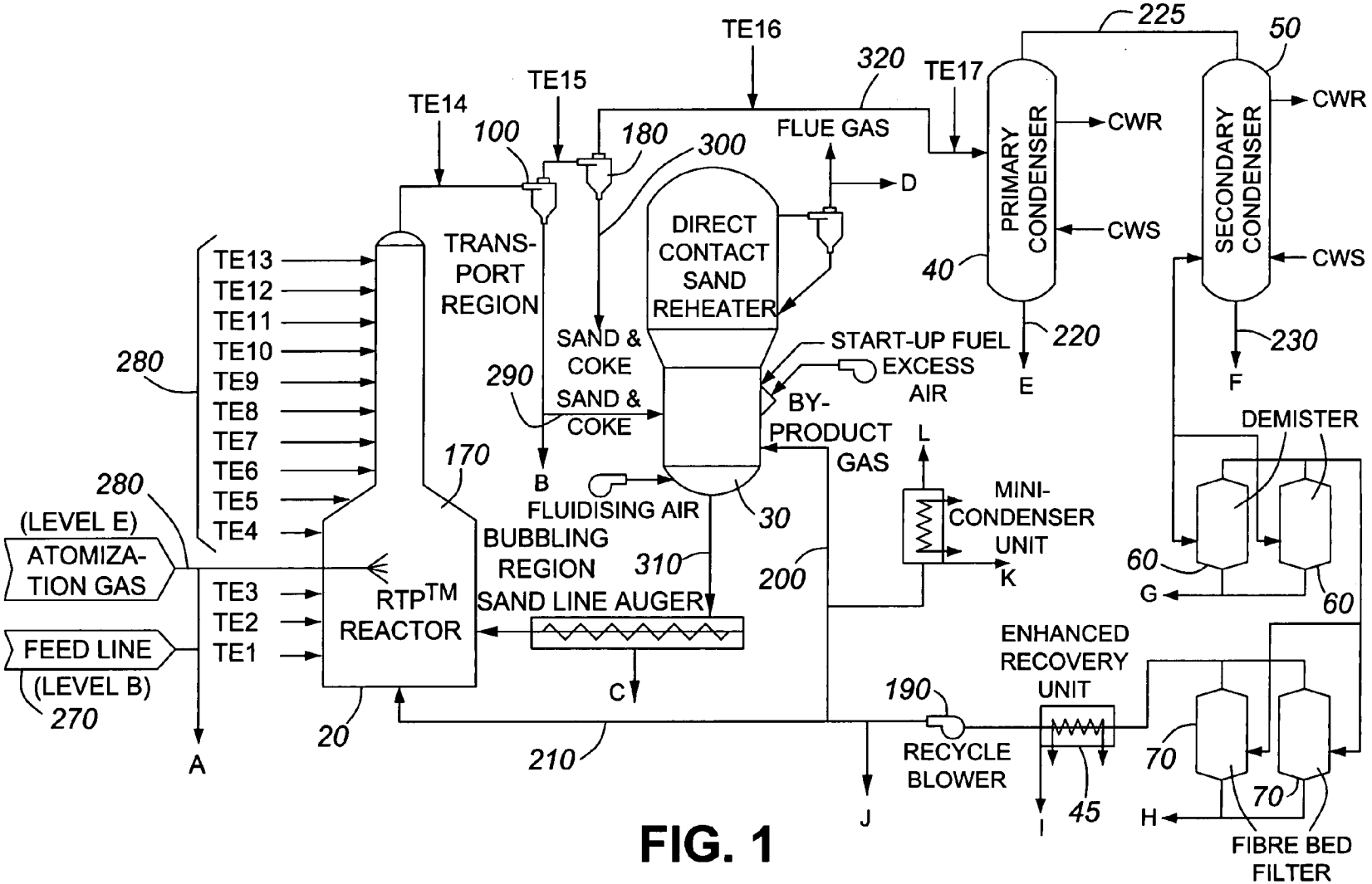
FIG. 1 is a schematic drawing of an example of an embodiment of the present invention relating to a system for the pyrolytic processing of feedstocks. Lines A-D, and I-L indicate optional sampling ports.

The present invention relates to rapid thermal processing (RTP™) of a viscous oil feedstock. More specifically, the present invention relates to a method of reducing the hydrogen sulfide content of one, or more than one component of a product stream derived from rapid thermal processing of a heavy hydrocarbon feedstock.

The following description is of a preferred embodiment by way of example only and without limitation to the combination of features necessary for carrying the invention into effect.

The present invention provides a method of reducing the hydrogen sulfide content of one, or more than one component of a product stream derived from rapid thermal processing of a heavy hydrocarbon feedstock, comprising:

(i) rapid thermal processing of the heavy hydrocarbon feedstock in the presence of a calcium compound;

(ii) rapid thermal processing of the heavy hydrocarbon feedstock in the presence of a calcium compound, and regeneration of a particulate heat carrier in a reheater in the presence of a calcium compound, or (iii) rapid thermal processing of the heavy hydrocarbon feedstock, and regeneration of a particulate heat carrier in a reheater in the presence of a calcium compound.

The present invention also provides a method for reducing $SO_x$ emissions in flue gas during upgrading of a heavy hydrocarbon feedstock comprising rapid thermal processing of the heavy hydrocarbon feedstock in the presence of a calcium compound, or by adding a calcium compound directly to a sand reheater or regenerator.

The present invention further provides a method for reducing the total acid number (TAN) of a heavy hydrocarbon feedstock, product, or both, comprising rapid thermal processing of the heavy hydrocarbon feedstock in the presence of a calcium compound.

The present invention also provides a method for reducing $SO_x$ emissions in flue gas and reducing the total acid number (TAN) of a heavy hydrocarbon feedstock, product, or both a heavy hydrocarbon feedstock and a product derived therefrom, during upgrading of a heavy hydrocarbon feedstock. This method comprises rapid thermal processing of the heavy hydrocarbon feedstock in the presence of a calcium compound, and optionally adding a calcium compound directly to a sand reheater.

The present invention also provides a method for (i) reducing $SO_x$ emissions in flue gas, (ii) reducing the total acid number (TAN) of a heavy hydrocarbon feedstock, product, or both a heavy hydrocarbon feedstock and a product derived therefrom, and (iii) reducing the hydrogen sulfide content of one, or more than one gas component of a product stream, during upgrading of a heavy hydrocarbon feedstock. This method comprises rapid thermal processing of the heavy hydrocarbon feedstock in the presence of a calcium compound, wherein the calcium compound is optionally also added directly to a sand reheater.

By "feedstock" or "heavy hydrocarbon feedstock", it is generally meant a petroleum-derived oil of high density and viscosity often referred to (but not limited to) heavy crude, heavy oil, (oil sand) bitumen or a refinery resid (oil or asphalt). However, the term "feedstock" may also include the bottom fractions of petroleum crude oils, such as atmospheric tower bottoms or vacuum tower bottoms. It may also include oils derived from coal and shale. Furthermore, the feedstock may comprise significant amounts of BS&W (Bottom Sediment and Water), for example, but not limited to, a BS&W content of greater than 0.5 wt %. Heavy oil and bitumen are preferred feedstocks.

For the purpose of application the feedstocks may be characterized as having i) high TAN, low sulfur content, ii) low TAN, high sulfur content, iii) high TAN, high sulfur content, or iv) low TAN, low sulfur content.

Feedstock characterized by i) above, may be pre-treated by adding a calcium compound to the feedstock prior to processing. The effect of this pre-treatment is that the TAN of both the feedstock and the product is reduced, and the hydrogen sulfide content of one, or more than one gas component of the product stream is reduced. Feedstocks characterized by ii) may not require addition of a calcium compound to the feedstock, but rather, a calcium compound may be added to the sand reheater, to the feedstock, or both to reduce sulfur emissions during regeneration of the heat carrier, and to reduce the hydrogen sulfide content of one, or more than one gas component of the product stream. Feedstocks characterized by iii) may be processed by adding a calcium compound to both the feedstock and the sand reheater, thereby reducing TAN in the product, reducing $SO_x$ (or any gaseous sulfur species) emissions in the flue gases evolving from the sand reheater, and reducing the hydrogen sulfide content of one, or more than one gas component in the product stream. A reason for adding an extra amount of a calcium compound to the sand reheater is that it may take more calcium to reduce high sulfur in the flue gas than it would to reduce the TAN value of the feed and that of the product. In the case of a feedstock characterized by iv), there may be no need to add a calcium compound to the feedstock or sand reheater. Therefore, the present invention is suitable for processing a range of crude oils having a range of properties, for example those characterized as having a high TAN including but not limited to Marlim from Brazil; Kuito from Angola; Heidrun, Troll, Balder, Alba, Gryhpon from the North Sea, Saskatchewan heavy crude, or Athabasca bitumen.

These heavy oil and bitumen feedstocks are typically viscous and difficult to transport Bitumens typically comprise a large proportion of complex polynuclear hydrocarbon asphaltenes that add to the viscosity of this feedstock and some form of pretreatment of this feedstock is required for transport. Such pretreatment typically includes dilution in solvents prior to transport.

Typically tar-sand derived feedstocks (see Example 1 for an analysis of examples, which are not to be considered limiting, of such feedstocks) are pre-processed prior to upgrading, as described herein, in order to concentrate bitumen. However, pre-processing of oil sand bitumen may involve methods known within the art, including hot or cold water treatments, or solvent extraction that produces a bitumen gas-oil solution. These pre-processing treatments typically separate bitumen from the sand. For example, one such water pre-processing treatment involves the formation of a tar-sand containing bitumen-hot water/NaOH slurry, from which the sand is permitted to settle, and more hot water is added to the floating bitumen to dilute out the base and ensure the removal of sand. Cold water processing involves crushing oil sand in water and floating it in fuel oil, then diluting the bitumen with solvent and separating the bitumen from the sand-water residue. A more complete description of the cold water process is disclosed in U.S. Pat. No. 4,818,373 (which is incorporated by reference). Such bitumen products are candidate feedstocks for further processing as described herein.

Bitumens may be upgraded using the process of this invention, or other processes such as FCC, visbraking, hydrocracking etc. Pre-treatment of tar sand feedstocks may also include hot or cold water treatments, for example, to partially remove the sand component prior to upgrading the feedstock using the process as described herein, or other upgrading processes including dewaxing (using rapid thermal processing as described herein), FCC, hydrocracking, coking, visbreaking etc. Therefore, it is to be understood that the term "feedstock" also includes pre-treated feedstocks, including, but not limited to those prepared as described above.

Lighter feedstocks may also be processed following the method of the invention as described herein. For example, and as described in more detail below, liquid products obtained from a first pyrolytic treatment as described herein, may be further processed by the method of this invention (for example composite recycle and multi stage processing; see FIG. 5 and Examples 3 and 4) to obtain a liquid product characterized as having reduced viscosity, a reduced metal (especially nickel, vanadium) and water content, and a greater API gravity. Furthermore, liquid products obtained from other processes as known in the art, for example, but not limited to U.S. Pat. Nos. 5,662,868; 4,980,045; 4,818,373; 4,569,753; 4,435,272; 4,427,538; 4,427,539; 4,328,091; 4,311,580; 4,243,514; 4,294,686, may also be used as feedstocks for the process described herein. Therefore, the present invention also contemplates the use of lighter feedstocks including gas oils, vacuum gas oils, topped crudes or pre-processed liquid products, obtained from heavy oils or bitumens. These lighter feedstocks may be treated using the process of the present invention in order to upgrade these feedstocks for further processing using, for example, but not limited to, FCC, hydrocracking, etc.

The liquid product arising from the process as described herein may be suitable for transport within a pipeline to permit its further processing elsewhere. Typically, further processing occurs at a site distant from where the feedstock is produced. However, it is considered within the scope of the present invention that the liquid product produced using the present method may also be directly input into a unit capable of further upgrading the feedstock, such as, but not limited to coking, visbreaking, or hydrocracking. In this capacity, the pyrolytic reactor of the present invention partially upgrades the feedstock while acting as a pre-treater of the feedstock for further processing, as disclosed in, for example, but not limited to U.S. Pat. Nos. 5,662,868; 4,980,045; 4,818,373; 4,569,753; 4,435,272; 4,427,538; 4,427,539; 4,328,091; 4,311,580; 4,243,514; 4,294,686 (all of which are incorporated herein by reference).

The feedstocks of the present invention are processed using a fast pyrolysis reactor, such as that disclosed in U.S. Pat. No. 5,792,340 (WO 91/11499; EP 513,051). Other known riser reactors with short residence times may also be employed, for example, but not limited to U.S. Pat. Nos. 4,427,539, 4,569,753, 4,818,373, 4,243,514 (which are incorporated by reference). The reactor is preferably run at a temperature of from about 450° C. to about 600° C., more preferably from about 480° C. to about 550° C. The contact times between the heat carrier and feedstock is preferably from about 0.01 to about 20 sec, more preferably from about 0.1 to about 5 sec., most preferably, from about 0.5 to about 2 sec.

It is preferred that the heat carrier used within the pyrolysis reactor is catalytically inert or that it exhibits low catalytic activity. Such a heat carrier may be a particulate solid, preferably sand, for example, silica sand. By silica sand it is meant any sand comprising greater than about 80% silica, preferably greater than about 95% silica, and more preferably greater than about 99% silica. It is to be understood that the above composition is an example of a silica sand that can be used as a heat carrier as described herein, however, variations within the proportions of these ingredients within other silica sands may exist and still be suitable for use as a heat carrier. Other known inert particulate heat carriers or contact materials, for example kaolin clays, rutile, low surface area alumina, oxides of magnesium and calcium as described in U.S. Pat. No. 4,818,373 or U.S. Pat. No. 4,243,514, may also be used.

As described in more detail below, one aspect of the present invention pertains to adding a calcium compound, for example but not limited to calcium acetate, calcium fornate, calcium proprionate, a calcium salt-containing bio-oil composition (as described, for example, in U.S. Pat. No. 5,264,623, the disclosure of which is incorporated herein by reference), a calcium salt isolated from a calcium salt-containing bio-oil composition, $Ca(OH)_2$ [$CaO\ H_2O$], $CaCO_3$, lime [CaO], or a mixture thereof, to the feedstock oil prior to processing the feedstock using fast pyrolysis. The calcium compound can be used in conjunction with a magnesium compound selected from the group consisting of MgO, $Mg(OH)_2$ and $MgCO_3$. Limestone in the form of calcite, which comprises $CaCO_3$, or in the form of dolomite, which comprises $CaMg\ (CO_3)_2$ can also be used as the calcium compound.

The calcium compound is preferably added to the feedstock together with 0-5% water, more preferably 1-3% water. In the case where the process of the present invention is used to pyrolyse a heavy oil, such as a vacuum tar bottom, the calcium compound is preferably introduced into the pyrolysis reactor using steam injection. The calcium compound used in the present invention may also be used in the form of a ground powder, more preferably a fine powder.

The amount of water present in the reactor vaporises during pyrolysis of the feedstock, and forms part of the product stream. This water may be recovered by using a recovery unit such as a liquid/vapour separator or a refrigeration unit present, for example, at a location downstream of the condensing columns (for example, condensers 40 and 50 of FIG. 1) and before the demisters (for example, demisters 60 of FIG. 1), or at using an enhanced recovery unit (45; FIG. 1), after the demisters.

The addition of a calcium compound to the feedstock neutralizes acids within the oil as determined by total acid number test (TAN test: ASTM D664 neutralization number, see Example 7A; another TAN test includes ASTM D974), and reduces gaseous sulfur emissions (see Example 8A). If moisture is available in the feedstock, for example when steam is used in the process, CaO may be used in place of $Ca(OH)_2$, to enable acid reduction. The reduction of the TAN value of the oil at an early stage of its processing can lead to improved performance and lifetime of the equipment used in the pyrolysis system. Furthermore, addition of a calcium compound to the reheater (30, FIG. 1; also termed regenerator, or coke combustor) desulfurizes flue gas evolving from the sand reheater (see Examples 8A and B), reducing gaseous sulfur, $SO_x$, or other gaseous sulfur species.

Therefore, the present invention is directed to a process for the rapid thermal processing of a heavy hydrocarbon feedstock in the presence of an added calcium compound. The calcium compound may be added at any point of the rapid thermal processing system. The preferred entries are the regenerator (sand reheater) or the feedstock before entering the reactor or fractionation column, to reduce sulfur emissions, TAN, the hydrogen sulfide content of one, or more than one gas component of the product stream, or all three.

By $SO_x$, it is meant a gaseous sulfur oxide species, for example $SO_2$, and $SO_3$. However, other gaseous sulfur species that may interact with a calcium compound may also be removed from the flue gasses, or feedstock as described herein.

The rapid thermal processing of feedstock comprising a calcium compound forms Ca—S compounds in the regenerator such as calcium sulfate, calcium sulfite or calcium sulfide. These compounds can be separated from the particulate heat carrier used within the rapid thermal system as described herein and removed if required. Alternatively, the addition of particulate lime within the feedstock may function as a heat carrier and be recycled through the system. If the calcium compound is recycled along with the particulate heat carrier, then a portion of the calcium compound will need to be removed periodically if new calcium compound is added to the feedstock.

The present invention also describes the addition of calcium acetate, calcium formate, calcium proprionate, a calcium salt-containing bio-oil composition (as described, for example, in U.S. Pat. No. 5,264,623, the disclosure of which is incorporated herein by reference), a calcium salt isolated from a calcium salt-containing bio-oil composition, $Ca(OH)_2$ [CaO $H_2O$], $CaCO_3$, lime [CaO], or a mixture thereof to the sand reheater (30) to enhance flue gas desulfurization. Using the methods as described herein, flue gas desulfurization is achieved by adding lime to the sand reheater in an amount corresponding to about 0.2 to about 5 fold the stoichiometric amount, preferably, about 1.0 to about 3 fold the stoichiometric requirement, more preferably about 1.7 to about 2 fold stoichiometric requirement for sulfur in the coke entering the sand reheater (coke combustor). With an addition of a calcium compound at about 1.7 to 2 fold the stoichiometric amount, up to about 90% or greater of the $SO_x$ in the flue gas is removed.

The amount of the calcium compound to be added to the feedstock or sand reheater can be determined by assaying the level of sulfur ($SO_x$) emissions and adding the calcium compound to counterbalance the sulfur levels.

Processing of feedstocks using fast pyrolysis results in the production of product vapours and solid byproducts associated with the heat carrier. After separating the heat carrier from the product stream, the product vapours are condensed to obtain a liquid product and gaseous by-products. For example, which is not to be considered limiting, the liquid product produced from the processing of heavy oil, as described herein, is characterized in having the following properties:

- a final boiling point of less than about 660° C., preferably less than about 600° C., and more preferably less than about 540° C.;
- an API gravity of at least about 12, and preferably greater than about 17 (where API gravity=[141.5/specific gravity]−131.5; the higher the API gravity, the lighter the material);
- greatly reduced metals content, including V and Ni.
- greatly reduced viscosity levels (more than 25 fold lower than that of the feedstock, for example, as determined @40° C.), and
- yields of liquid product of at least 60 vol %, preferably the yields are greater than about 70 vol %, and more preferably they are greater than about 80%.

Following the methods as described herein, a liquid product obtained from processing bitumen feedstock, which is not to be considered limiting, is characterized as having:

- an API gravity from about 10 to about 21;
- a density @15° C. from about 0.93 to about 1.0;
- greatly reduced metals content, including V and Ni.
- a greatly reduced viscosity of more than 20 fold lower than the feedstock (for example as determined at 40° C.), and
- yields of liquid product of at least 60 vol %, preferably the yields are greater than about 75 vol %.

The high yields and reduced viscosity of the liquid product produced according to this invention may permit the liquid product to be transported by pipeline to refineries for further processing with the addition of little or no diluents. Furthermore, the liquid products exhibit reduced levels of contaminants (e.g. asphaltenes, metals and water). Therefore, the liquid product may also be used as a feedstock, either directly, or following transport, for further processing using, for example, FCC, hydrocracking etc.

Furthermore, the liquid products of the present invention may be characterized using Simulated Distillation (SimDist) analysis, as is commonly known in the art, for example but not limited to ASTM D 5307-97 or HT 750 (NCUT). SimDist analysis, indicates that liquid products obtained following processing of heavy oil or bitumen can be characterized by any one of, or a combination of, the following properties (see Examples 1, 2 and 5):

- having less than 50% of their components evolving at temperatures above 538° C. (vacuum resid fraction);
- comprising from about 60% to about 95% of the product evolving below 538° C. Preferably, from about 62% to about 85% of the product evolves during SimDist below 538° C. (i.e. before the vacuum resid. fraction);
- having from about 1.0% to about 10% of the liquid product evolve below 193° C. Preferably from about 1.2% to about 6.5% evolves below 193° C. (i.e. before the naphtha/kerosene fraction);
- having from about 2% to about 6% of the liquid product evolve between 193-232° C. Preferably from about 2.5% to about 5% evolves between 193-232° C. (kerosene fraction);
- having from about 10% to about 25% of the liquid product evolve between 232-327° C. Preferably, from about 13 to about 24% evolves between 232-327° C. (diesel fraction);
- having from about 6% to about 15% of the liquid product evolve between 327-360° C. Preferably, from about 6.5 to about 11% evolves between 327-360° C. (light vacuum gas oil (VGO) fraction);
- having from about 34.5% to about 60% of the liquid product evolve between 360-538° C. Preferably, from about 35 to about 55% evolves between 360-538° C. (Heavy VGO fraction);

The vacuum gas oil (VGO) fraction produced as a distilled fraction obtained from the liquid product of rapid thermal processing as described herein, may be used as a feedstock for catalytic cracking in order to convert the heavy compounds of the VGO to a range of lighter weight compounds for example, gases ($C_4$ and lighter), gasoline, light cracked oil, and heavy gas oil. The quality and characteristics of the VGO fraction may be analyzed using standard methods known in the art, for example Microactivity testing (MAT), K-factor and aniline point analysis. Aniline point analysis determines the minimum temperature for complete miscibility of equal volumes of aniline and the sample under test. Determination of aniline point for petroleum products and hydrocarbon solvents is typically carried out using ASTM Method D611. A product characterized with a high aniline point is low in aromatics, naphthenes, and high in paraffins (higher molecular weight components). VGOs of the prior art, are characterized as having low aniline points and therefore have poor cracking characteristics are undesired as feedstocks for catalytic cracking. Any increase in aniline point over prior art feedstocks is benefical, and it is desired within the art to have a VGO characterized with a high aniline point. Typically, aniline points correlate well with cracking characteristics of a feed, and the calculated aniline points obtained from MAT. However, the observed aniline points for the VGOs produced according to the procedure described herein do not conform with this expectation. The estimated aniline points for several feedstocks is higher than that as measured (see example 6; Tables 16 and 17). This indicates that the VGOs produced using the method of the present invention are unique compared to prior art VGOs. Furthermore, VGOs of the present invention are characterized by having a unique hydrocarbon profile comprising about 38% mono-aromatics plus thiophene aromatics. These types of molecules have a plurality of side chains available for cracking, and provide higher levels of conversion, than compounds with reduced levels of mono-aromatics and thiophene aromatic compounds, typical of the prior art. Without wishing to be bound by theory, the increased amounts of mono-aromatic and thiophene aromatic may result in the discrepancy between the catalytic cracking properties observed in MAT testing and the determined aniline point.

A first method for upgrading a feedstock to obtain liquid products with desired properties involves a one stage process. With reference to FIG. 1, briefly, the fast pyrolysis system includes a feed system generally indicated as (10; also see FIGS. 2 and 3), that injects the feedstock into a reactor (20), a heat carrier separation system that separates the heat carrier from the product vapour (e.g. 100 and 180, FIG. 1) and recycles the heat carrier to the reheating/regenerating system (30), a particulate inorganic heat carrier reheating system (30) that reheats and regenerates the heat carrier, and primary (40) and secondary (50) condensers that collect the product. Alternatively, a fractionation column, for example but not limited to a C-400 fractionation column (discussed in more detail below), may be used in place of separate condensers to collect the product from vapour. Calcium based material, for example, and without limitation, calcium acetate, calcium formate, calcium proprionate, a calcium salt-containing bio-oil composition (as described, for example, in U.S. Pat. No. 5,264,623, the disclosure of which is incorporated herein by reference), a calcium salt isolated from a calcium salt-containing bio-oil composition, $Ca(OH)_2$ [CaO $H_2O$], $CaCO_3$, lime [CaO], or a mixture thereof may be added to the reheater (30) to reduce $SO_x$ emissions from the flue gas, or it may be added to the feedstock to reduce TAN, and to reduce the hydrogen sulfide content of one, or more than one gas components in the product stream.

Figure 2:
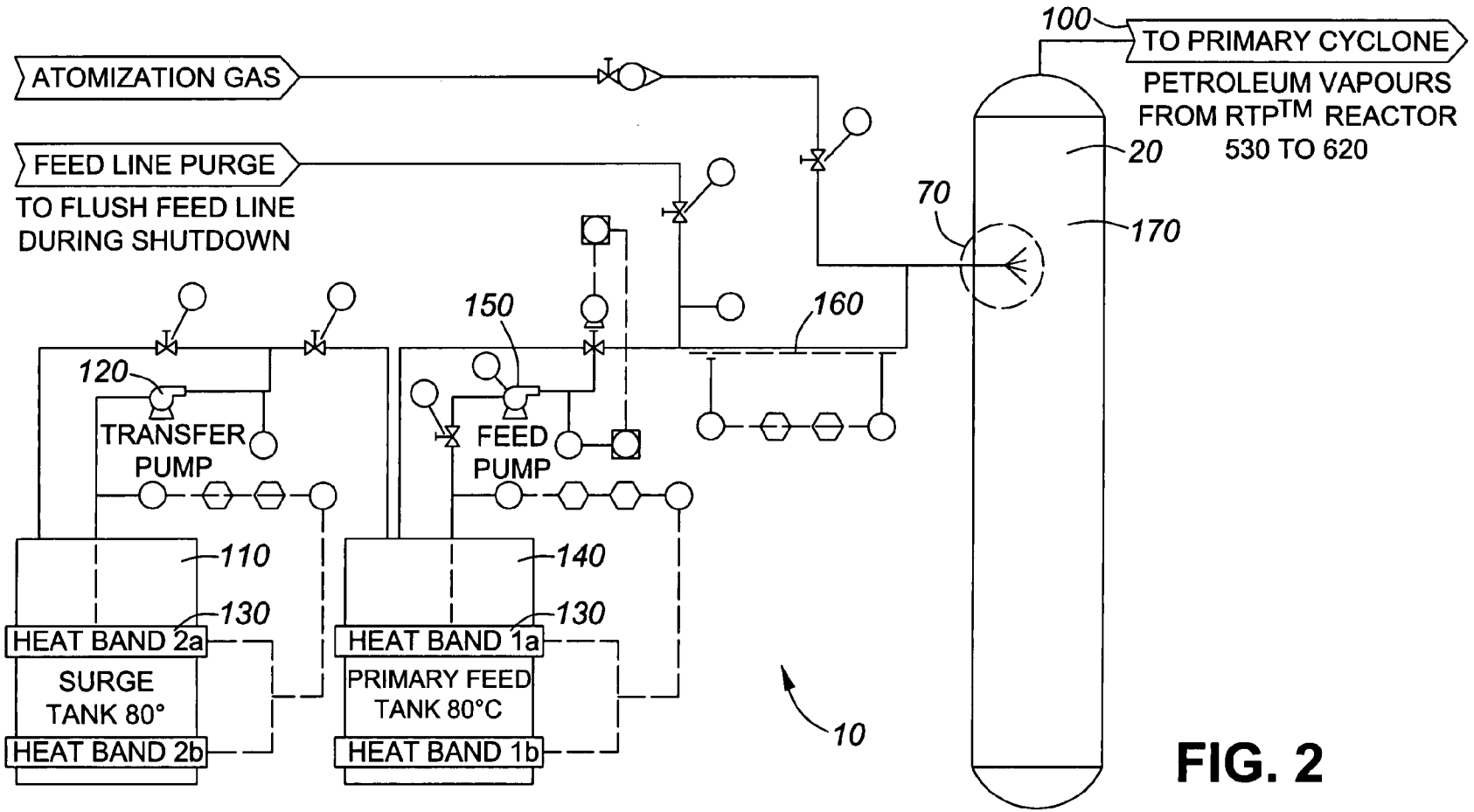
FIG. 2 is a schematic drawing of an example of an embodiment of the present invention relating to the feed system for introducing the feedstock to the system for the pyrolytic processing of feedstocks.

The pre-heated feedstock enters the reactor just below the mixing zone (170) and is contacted by the upward flowing stream of hot inert carrier within a transport fluid, that typically is a recycle gas supplied by a recycle gas line (210). The feedstock may be obtained after passage through a fractionation column, where a gaseous component of the feedstock is removed, and the non-volatile component is transported to the reactor for further processing. Rapid mixing and conductive heat transfer from the heat carrier to the feedstock takes place in the short residence time conversion section of the reactor. The feedstock may enter the reactor through at least one of several locations along the length of the reactor. The different entry points indicated in FIGS. 1 and 2 are non-limiting examples of such entry locations. By providing several entry points along the length of the reactor, the length of the residence time within the reactor may be varied. For example, for longer residence times, the feedstock enters the reactor at a location lower down the reactor, while, for shorter residence times, the feedstock enters the reactor at a location higher up the reactor. In all of these cases, the introduced feedstock mixes with the upflowing heat carrier within a mixing zone (170) of the reactor. The product vapours produced during pyrolysis are cooled and collected using a suitable condenser means (40, 50, FIG. 1) or a fractionation column, in order to obtain a liquid product.

For reduced $SO_2$ emissions within the flue, calcium-based material, for example, and without limitation either calcium acetate, calcium formate, calcium proprionate, a calcium salt-containing bio-oil composition (as described, for example, in U.S. Pat. No. 5,264,623, the disclosure of which is incorporated herein by reference), a calcium salt isolated from a calcium salt-containing bio-oil composition, $Ca(OH)_2$ [CaO $H_2O$], $CaCO_3$, lime [CaO], or a mixture thereof may be added to the feed line at any point prior to entry into the reactor (20), for example before or after feedstock lines (270, 280, FIGS. 1 and 5), or 160 (FIG. 2). Addition of the calcium-based material, for example, CaO, to the sand reheater (30) may take place within the lines (290, 300) coming from cyclone separators 100 or 180 that recycle sand and coke into the sand reheater. The calcium compound may also be added directly to the sand reheater.

It is to be understood that other fast pyrolysis systems, comprising differences in reactor design, that utilize alternative heat carriers, heat carrier separators, different numbers or size of condensers, or different condensing means, may be used for the preparation of the upgraded product of this invention. For example, which is not to be considered limiting, reactors disclosed in U.S. Pat. Nos. 4,427,539, 4,569,753, 4,818,373, 4,243,514 (all of which are incorporated by reference) may be modified to operate under the conditions as outlined herein for the production of a chemically upgraded product with an increased API and reduced viscosity. The reactor is preferably run at a temperature of from about 450° C. to about 600° C., more preferably from about 480° C. to about 550° C.

Following pyrolysis of the feedstock in the presence of the inert heat carrier, coke containing contaminants present within the feedstock are deposited onto the inert heat carrier. These contaminants include metals (such as nickel and vanadium), nitrogen and sulfur. The inert heat carrier therefore requires regeneration before re-introduction into the reaction stream. The inert heat carrier is regenerated in the sand reheater or regenerator (30, FIGS. 1 and 5). The heat carrier may be regenerated via combustion within a fluidized bed of the sand reheater (30) at a temperature of about 600 to about 900° C., preferably from 600 to 815° C., more preferably from 700 to 800° C. Furthermore, as required, deposits may also be removed from the heat carrier by an acid treatment, for example as disclosed in U.S. Pat. No. 4,818,373 (which is incorporated by reference). The heated, regenerated, heat-carrier is then re-introduced to the reactor (20) and acts as heat carrier for fast pyrolysis.

Figure 5:
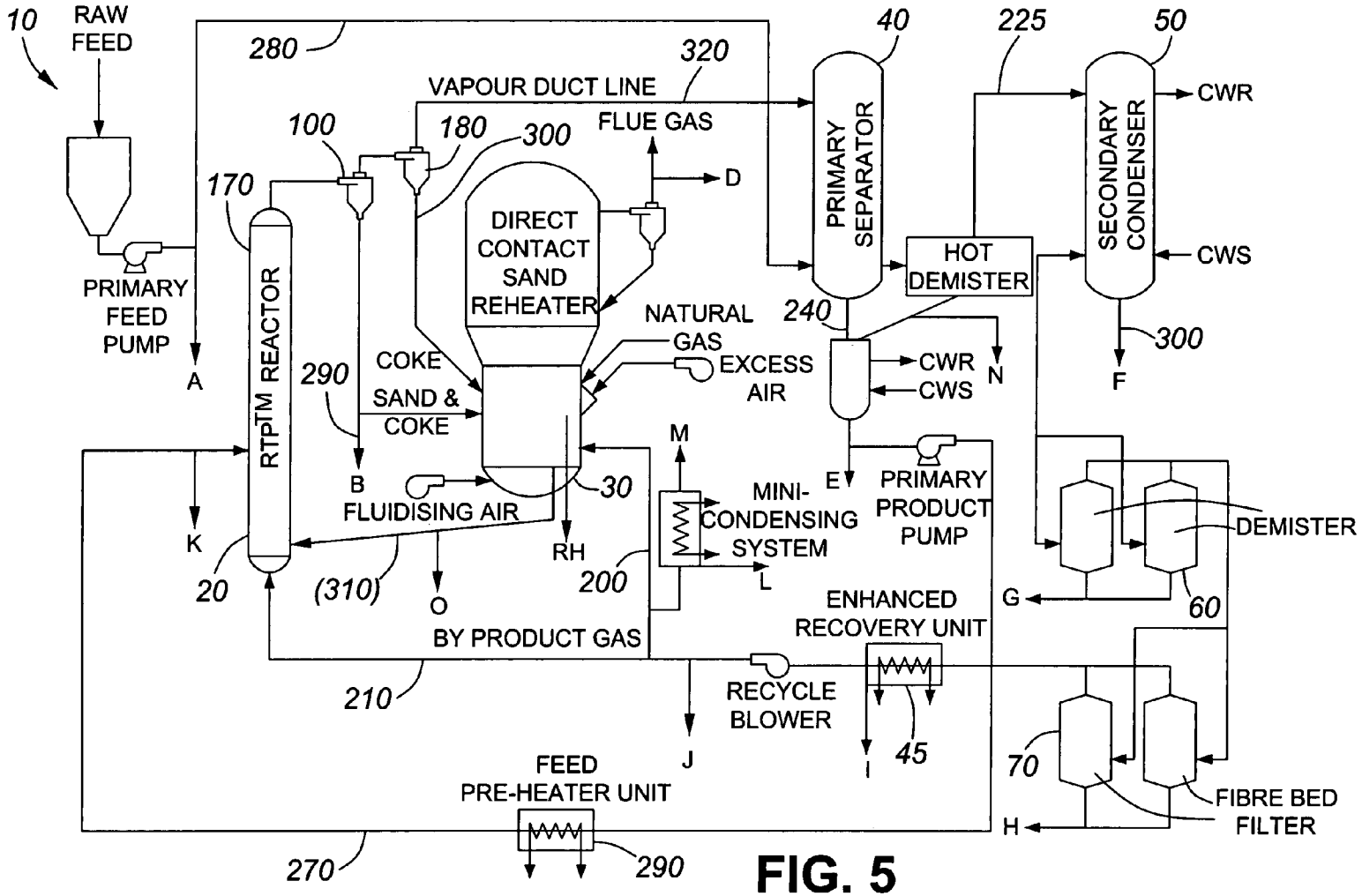
FIG. 5 is a schematic drawing of an example of an embodiment of the present invention relating to a multi stage system for the pyrolytic processing of feedstocks. Lines A-E, and I-N indicate optional sampling ports.

The feed system (10, FIG. 2) provides a preheated feedstock to the reactor (20). An example of a feed system which is not to be considered limiting in any manner, is shown in FIG. 2, however, other embodiments of the feed system are within the scope of the present invention, for example but not limited to a feed pre-heater unit as shown in FIG. 5 (discussed below), and may be optionally used in conjunction with a feed system (10; FIG. 5). The feed system (generally shown as 10, FIG. 2) is designed to provide a regulated flow of pre-heated feedstock to the reactor unit (20). The feed system shown in FIG. 2 includes a feedstock pre-heating surge tank (110), heated using external band heaters (130) to 80° C., and is associated with a recirculation/transfer pump (120). The feedstock is constantly heated and mixed in this tank at 80° C. The hot feedstock is pumped from the surge tank to a primary feed tank (140), also heated using external band heaters (130), as required. However, it is to be understood that variations on the feed system may also be employed, in order to provide a heated feedstock to the reactor. The primary feed tank (140) may also be fitted with a recirculation/delivery pump (150). Heat traced transfer lines (160) are maintained at about 100-300° C. and pre-heat the feedstock prior to entry into the reactor via an injection nozzle (70, FIG. 2). Atomization at the injection nozzle (70) positioned near the mixing zone (170) within reactor (20) may be accomplished by any suitable means. The nozzle arrangement should provide for a homogeneous dispersed flow of material into the reactor. For example, which is not considered limiting in any manner, mechanical pressure using single-phase flow atomization, or a two-phase flow atomization nozzle may be used. With a two phase flow atomization nozzle, steam or recycled by-product gas may be used as a carrier. Instrumentation is also dispersed throughout this system for precise feedback control (e.g. pressure transmitters, temperature sensors, DC controllers, 3-way valves gas flow metres etc.) of the system.

Conversion of the feedstock is initiated in the mixing zone (170; e.g. FIGS. 1 and 2) under moderate temperatures (typically less than 750° C., preferably from about 450° C. to about 600° C., more preferably from about 480° C. to about 550° C.) and continues through the conversion section within the reactor unit (20) and connections (e.g. piping, duct work) up until the primary separation system (e.g. 100) where the bulk of the heat carrier is removed from the product vapour stream. The solid heat carrier and solid coke by-product are removed from the product vapour stream in a primary separation unit. Preferably, the product vapour stream is separated from the heat carrier as quickly as possible after exiting from the reactor (20), so that the residence time of the product vapour stream in the presence of the heat carrier is as short as possible.

The primary separation unit may be any suitable solids separation device, for example but not limited to a cyclone separator, a U-Beam separator, or Rams Horn separator as are known within the art. A cyclone separator is shown diagrammatically in FIGS. 1, 3 and 4. The solids separator, for example a primary cyclone (100), is preferably fitted with a high-abrasion resistant liner. Any solids that avoid collection in the primary collection system are carried downstream and may be recovered in a secondary separation unit (180). The secondary separation unit may be the same as the primary separation unit, or it may comprise an alternate solids separation device, for example but not limited to a cyclone separator, a ¼ turn separator, for example a Rams Horn separator, or an impingement separator, as are known within the art. A secondary cyclone separator (180) is graphically represented in FIGS. 1 and 4, however, other separators may be used as a secondary separation unit.

The solids that have been removed in the primary and secondary collection systems are transferred to a vessel for regeneration of the heat carrier, for example, but not limited to a direct contact reheater system (30). In a direct contact reheater system (30), the coke and by-product gasses are oxidized to provide process thermal energy that is directly carried to the solid heat carrier (e.g. 310, FIGS. 1, 5), as well as regenerating the heat carrier. The temperature of the direct contact reheater is maintained independent of the feedstock conversion (reactor) system. However, as indicated above, other methods for the regeneration of the heat carrier may be employed, for example but not limited to acid treatment.

The hot product stream from the secondary separation unit may be quenched in a primary collection column (or primary condenser, 40; FIG. 1). The vapour stream is rapidly cooled from the conversion temperature to less than about 400° C. Preferably the vapour stream is cooled to about 300° C. Product is drawn from the primary column and may be pumped (220) into product storage tanks, or recycled within the reactor as described below. A secondary condenser (50) can be used to collect any material (225) that evades the primary condenser (40). Product drawn from the secondary condenser (50) is also pumped (230) into product storage tanks. The remaining non-condensible gas is compressed in a blower (190) and a portion is returned to the heat carrier regeneration system (30) via line (200), and the remaining gas is returned to the reactor (20) by line (210) and acts as a heat carrier, and transport medium.

The hot product stream may also be quenched in a fractionation column designed to provide different sections of liquid and a vapour overhead, as known in the art. A non-limiting example of a fractionation column is a C-400 fractionation column, which provides three different sections for liquid recovery. However, fractionation columns comprising fewer or greater number of sections for liquid recovery may also be used. The bottom section of the fractionation column can produce a liquid stream or bottoms product that is normally recycled back to the reactor through line 270. The vapors from this bottom section, which are also termed volatile components, are sent to a middle section that can produce a stream that is cooled and sent to product storage tanks. The vapors, or volatile components, from the middle section are sent to the top section. The top section can produce a crude material that can be cooled and sent to product storage tanks, or used for quenching in the middle or top sections. Excess liquids present in this column are cooled and sent to product storage, and vapors from the top of the column are used for recycle gas needs. If desired the fractionation column may be further coupled to a down stream condenser.

In an alternative approach, the product stream (320, FIGS. 1, and 3-5) derived from the rapid thermal process as described herein can be fed directly to a second processing system for further upgrading by, for example but not limited to, FCC, viscracking, hydrocracking or other catalytic cracking processes. The product derived from the application of the second system can then be collected, for example, in one or more condensing columns, as described above, or as typically used with these secondary processing systems. As another possibility, the product stream derived from the rapid thermal process described herein can first be condensed and then either transported, for example, by pipeline to the second system, or coupled directly to the second system.

As another alternative, a primary heavy hydrocabon upgrading system, for example, FCC, viscracking, hydrocracking or other catalytic cracking processes, can be used as a front-end processing system to partially upgrade the feedstock. The rapid thermal processing system of the present invention can then be used to either further upgrade the product stream derived from the front-end system, or used to upgrade vacuum resid fractions, bottom fractions, or other residual refinery fractions, as known in the art, that are derived from the front-end system (FCC, viscracking, hydrocracking or other catalytic cracking processes), or both.

It is preferred that the reactor used with the process of the present invention is capable of producing high yields of liquid product for example at least greater than 60 vol %, preferably the yield is greater than 70 vol %, and more preferably the yield is greater than 80%, with minimal byproduct production such as coke and gas. Without wishing to limit the scope of the invention in any manner, an example for the suitable conditions for the pyrolytic treatment of feedstock, and the production of a liquid product is described in U.S. Pat. No. 5,792,340, which is incorporated herein by reference. This process utilizes sand (silica sand) as the heat carrier, and a reactor temperature ranging from about 450° C. to about 600° C., loading ratios of heat carrier to feedstock from about 10:1 to about 200:1, and residence times from about 0.35 to about 0.7 sec. Preferably the reactor temperature ranges from about 480° C. to about 550° C. The preferred loading ratio is from about 15:1 to about 50:1, with a more preferred ratio from about 20:1 to about 30:1. Furthermore, it is to be understood that longer residence times within the reactor, for example up to about 5 sec, may be obtained if desired by introducing the feedstock within the reactor at a position towards the base of the reactor, by increasing the length of the reactor itself, by reducing the velocity of the heat carrier through the reactor (provided that there is sufficient velocity for the product vapour and heat carrier to exit the reactor), or a combination thereof. The preferred residence time is from about 0.5 to about 2 sec.

Without wishing to be bound by theory, it is thought that the chemical upgrading of the feedstock that takes place within the reactor system as described above is in part due to the high loading ratios of heat carrier to feedstock that are used within the method of the present invention. Prior art carrier to feed ratios typically ranged from 5:1 to about 12.5:1. However, the carrier to feed ratios as described herein, of from about 15:1 to about 200:1, result in a rapid ablative heat transfer from the heat carrier to the feedstock. The high volume and density of heat carrier within the mixing and conversion zones, ensures that a more even processing temperature is maintained in the reaction zone. In this way, the temperature range required for the cracking process described herein is better controlled. This also allows for the use of relatively low temperatures to minimizeover cracking, while ensuring that mild cracking of the feedstock is still achieved. Furthermore, with an increased volume of heat carrier within the reactor, contaminants and undesired components present in the feedstock and reaction by-products, including metals (e.g. nickel and vanadium), coke, and to some extent nitrogen and sulphur, are readily adsorbed due to the large surface area of heat carrier present. This ensures efficient and optimal removal of contaminants from the feedstock, during the pyrolytic processing of the feedstock. As a larger surface area of heat carrier is employed, the heat carrier itself is not unduly contaminated, and any adsorbed metal or coke and the like is readily stripped during regeneration of the heat carrier. With this system the residence times can be carefully regulated in order to optimize the processing of the feedstock and liquid product yields.

The liquid product arising from the processing of hydrocarbon oil as described herein has significant conversion of the resid fraction when compared to the feedstock. As a result the liquid product of the present invention, produced from the processing of heavy oil is characterized, for example, but which is not to be considered limiting, as having an API gravity of at least about 13°, and more preferably of at least about 17°. However, as indicated above, higher API gravities may be achieved with a reduction in volume. For example, one liquid product obtained from the processing of heavy oil using the method of the present invention is characterized as having from about 10 to about 15% by volume bottoms, from about 10 to about 15% by volume light ends, with the remainder as middle distillates.

The viscosity of the liquid product produced from heavy oil is substantially reduced from initial feedstock levels, of from 250 cSt @80° C., to product levels of 4.5 to about 10 cSt @80° C., or from about 6343 cSt @40° C., in the feedstock, to about 15 to about 35 cSt @40° C. in the liquid product. Following a single stage process, liquid yields of greater than 80 vol % and API gravities of about 17, with viscosity reductions of at least about 25 times that of the feedstock are obtained (@40° C.).

Results from Simulated Distillation (SimDist; e.g. ASTM D 5307-97, HT 750, (NCUT)) analysis further reveal substantially different properties between the feedstock and liquid product as produced herein. Based on a simulated distillation of an example of a heavy oil feedstock it was determined that approx. 1 wt % distilled off below about 232° C. (kerosene fraction), approx. 8.7% from about 232° to about 327° C. (diesel fraction), and 51.5 % evolved above 538° C. (vacuum resid fraction; see Example 1 for complete analysis). SimDist analysis of the liquid product produced as described above may generally be characterized as having, but is not limited to having the following fractions: approx. 4 wt % evolving below about 232° C. (kerosene fraction), approx. 14.2 wt % evolving from about 232° to about 327° C. (Diesel fraction), and 37.9 wt % evolving above 538° C. (vacuum resid reaction). It is to be understood that modifications to these values may arise depending upon the composition of the feedstock used. These results demonstrate that there is a significant chemical change within the liquid product caused by cracking the heavy oil feedstock, with a general trend to lower molecular weight components boiling at lower temperatures.

Therefore, the present invention is directed to a liquid product obtained from single stage processing of heavy oil that may be characterized by at least one of the following properties:

- having less than 50% of their components evolving at temperatures above 538° C. (vacuum resid fraction);
- comprising from about 60% to about 95% of the product evolving below 538°.
- Preferably, from about 60% to about 80% evolves during Simulated Distillation below 538° C. (i.e. before the vacuum resid. fraction);
- having from about 1.0% to about 6% of the liquid product evolve below 193° C. Preferably from about 1.2% to about 5% evolves below 193° C. (i.e. before the naphtha/kerosene fraction);
- having from about 2% to about 6% of the liquid product evolve between 193-232° C. Preferably from about 2.8% to about 5% evolves between 193-232° C. (diesel fraction);
- having from about 12% to about 25% of the liquid product evolve between 232-327° C. Preferably, from about13 to about 18% evolves between 232-327° C. (diesel fraction);
- having from about 5% to about 10% of the liquid product evolve between 327-360° C. Preferably, from about 6.0 to about 8.0% evolves between 327-360° C. (light VGO fraction);
- having from about 40% to about 60% of the liquid product evolve between 360-538° C. Preferably, from about 30 to about 45% evolves between 360-538° C. (Heavy VGO fraction);

Similarly following the methods as described herein, a liquid product obtained from processing bitumen feedstock following a single stage process, is characterized as having, and which is not to be considered as limiting, an increase in API gravity of at least about 10 (feedstock API is typically about 8.6). Again, higher API gravities may be achieved with a reduction in volume. The product obtained from bitumen is also characterised as having a density from about 0.93 to about 1.0 and a greatly reduced viscosity of at least about 20 fold lower than the feedstock (i.e. from about 15 g/ml to about 60 g/ml at 40° C. in the product, v. the feedstock comprising about 1500 g/ml). Yields of liquid product obtained from bitumen are at least 60% by vol, and preferably greater than about 75% by vol. SimDist analysis also demonstrates significantly different properties between the bitumen feedstock and liquid product as produced herein. Highlights from SimDist analysis indicates that for a bitumen feedstock, approx. 1% (wt %) of the feedstock was distilled off below about 232° C. (Kerosene fraction), approx. 8.6% from about 232° to about 327° C. (Diesel fraction), and 51.2% evolved above 538° C. (Vacuum resid fraction; see Example 2 for complete analysis). SimDist analysis of the liquid product produced from bitumen as described above may be characterized, but is not limited to the following properties: approx. 5.7% (wt %) is evolved below about 232° C. (Kerosene fraction), approx. 14.8% from about 232° to about 327° C. (Diesel fraction), and 29.9% within the vacuum resid fraction (above 538° C.). Again, these results may differ depending upon the feedstock used, however, they demonstrate the significant alteration in many of the components within the liquid product when compared with the bitumen feedstock, and the general trend to lower molecular weight components that evolve earlier during SimDist analysis in the liquid product produced from rapid thermal processing.

Therefore, the present invention is also directed to a liquid product obtained from single stage processing of bitumen which is characterised by having at least one of the following properties:

- having less than 50% of their components evolving at temperatures above 538° C. (vacuum resid fraction);
- comprising from about 60% to about 95% of the product evolving below 538°. Preferably, from about 60% to about 80% evolves during Simulated Distillation below 538° C. (i.e. before the vacuum resid. fraction);
- having from about 1.0% to about 6% of the liquid product evolve below 193° C. Preferably from about 1.2% to about 5% evolves below 193° C. (i.e. before the naphtha/kerosene fraction);
- having from about 2% to about 6% of the liquid product evolve between 193-232° C. Preferably from about 2.0% to about 5% evolves between 193-232° C. (diesel fraction);
- having from about 12% to about 25% of the liquid product evolve between 232-327° C. Preferably, from about 13 to about 18% evolves between 232-327° C. (diesel fraction);
- having from about 5% to about 10% of the liquid product evolve between 327-360° C. Preferably, from about 6.0 to about 8.0% evolves between 327-360° C. (light VGO fraction);
- having from about 40% to about 60% of the liquid product evolve between 360-538° C. Preferably, from about 30 to about 50% evolves between 360-538° C. (Heavy VGO fraction);

The liquid product produced as described herein also showed good stability. Over a 30 day period only negligible changes in SimDist profiles, viscosity and API for liquid products produced from either heavy oil or bitumen feedstocks were found (see Example 1 and 2).

Also as disclosed herein, further processing of the liquid product obtained from the process of heavy oil or bitumen feedstock may take place following the method of this invention. Such further processing may utilize conditions that are very similar to the initial fast pyrolysis treatment of the feedstock, or the conditions may be modified to enhance removal of lighter products (a single-stage process with a mild crack) followed by more severe cracking of the recycled fraction (i.e. a two stage process).

In the first instance, that of further processing under similar conditions the liquid product from a first pyrolytic treatment is recycled back into the pyrolysis reactor in order to further upgrade the properties of the final product to produce a lighter product. In this arrangement the liquid product from the first round of pyrolysis is used as a feedstock for a second round of pyrolysis after the lighter fraction of the product has been removed from the product stream. Furthermore, a composite recycle may also be carried out where the heavy fraction of the product stream of the first process is fed back (recycled) into the reactor along with the addition of fresh feedstock (e.g. FIG. 3, described in more detail below).

Figure 3:
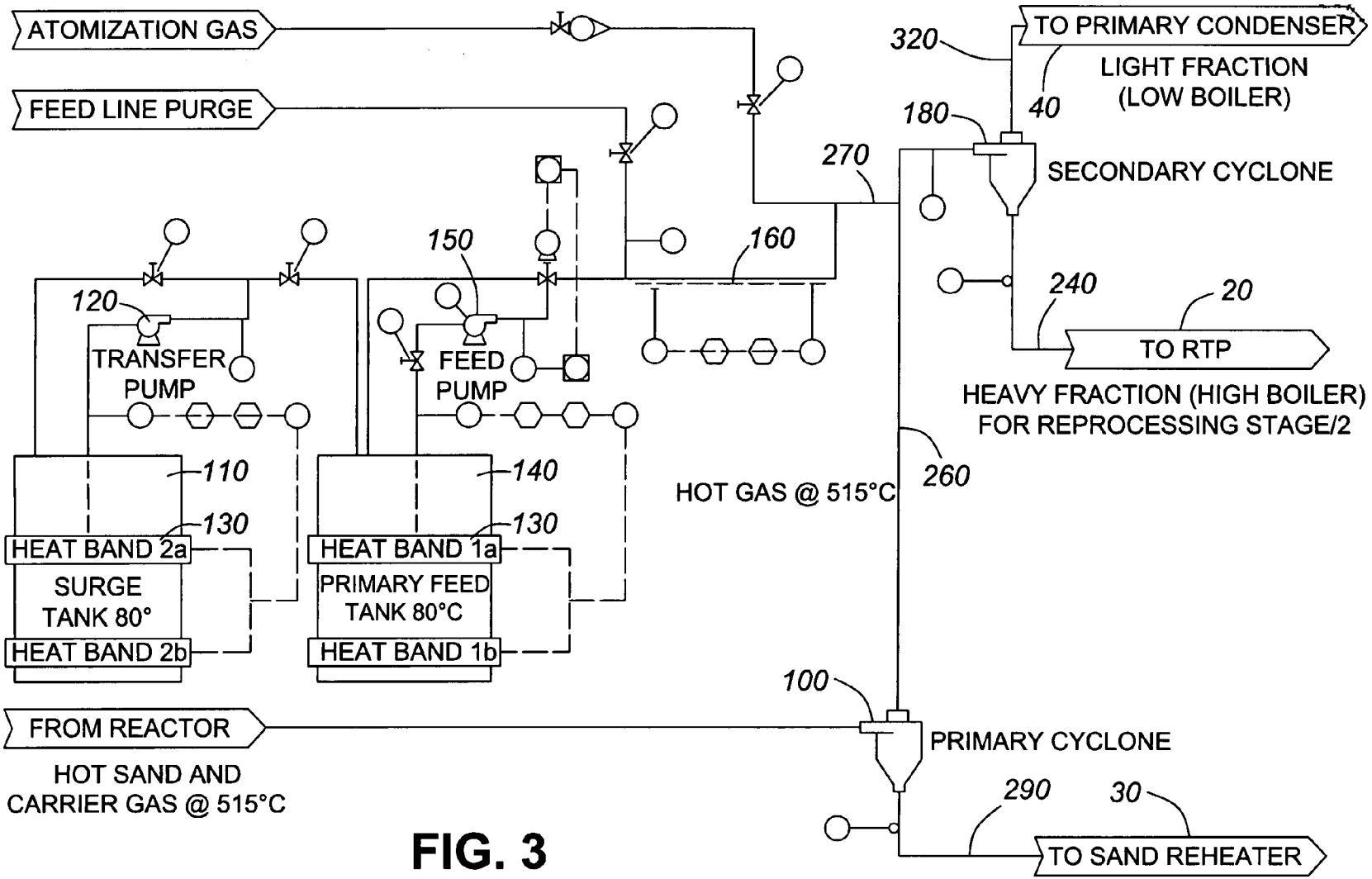
FIG. 3 is a schematic drawing of an example of an embodiment of the present invention relating to the feed system for introducing feedstock into the second stage of a two stage process using the system for the pyrolytic processing of feedstocks as described herein.
Figure 4:
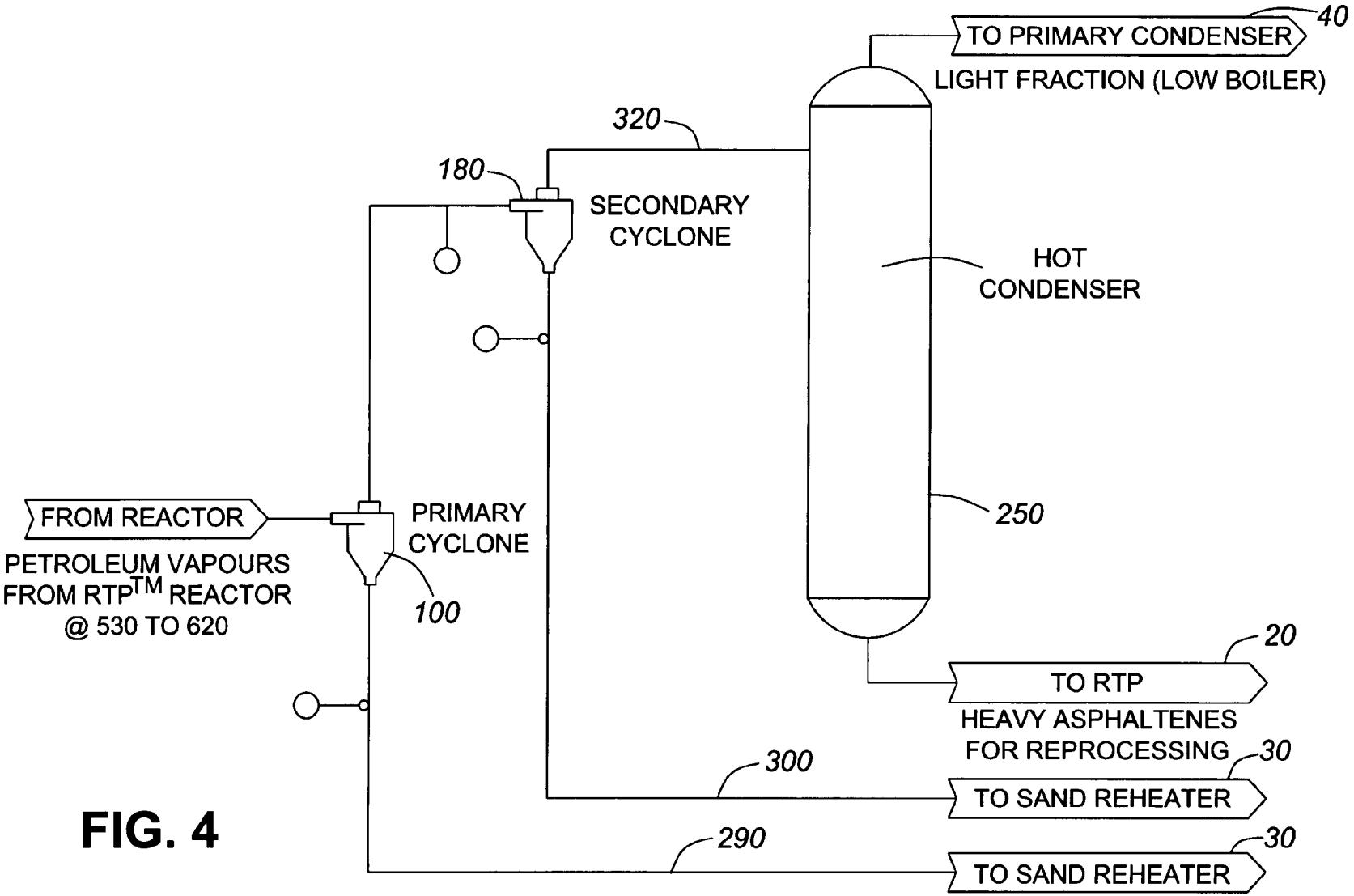
FIG. 4 is a schematic drawing of an example of an embodiment of the present invention relating to the recovery system for obtaining feedstock to be either collected from a primary condenser, or recycled to the second stage of a two stage process using the system for the pyrolytic processing of feedstocks as described herein.

The second method for upgrading a feedstock to obtain liquid products with desired properties involves a two-stage pyrolytic process (see FIGS. 2 and 3). This two-stage process uses a combination of less severe rapid thermal processing followed by more severe rapid thermal processing. The first stage of the process comprises exposing the feedstock to conditions that mildly crack the hydrocarbon components in order to avoid overcracking and excess gas and coke production. An example of these conditions includes, but is not limited to, injecting the feedstock at about 150° C. into a hot gas stream comprising the heat carrier at the inlet of the reactor. The feedstock is processed with a residence time less than about one second within the reactor at less than 500° C., for example 300° C. The product, comprising lighter materials (low boilers) is separated (100, and 180, FIG. 3), and removed following the first stage in the condensing system (40). The heavier materials (240), separated out at the bottom of the condenser (40) are collected subjected to a more severe cracking in the second stage within the reactor (20) in order to render a liquid product of reduced viscosity. The two-stage processing would provide a higher yield than one-stage processing that would render a liquid product of identical viscosity. The conditions utilized in the second stage include, but are not limited to, a processing temperature of about 530° C. to about 590° C. Product from the second stage is processed and collected as outlined in FIG. 1 using a primary and secondary cyclone (100, 180, respectively) and primary and secondary condensers (40 and 50, respectively).

Following such a two stage process, an example of the product, which is not to be considered limiting, of the first stage (light boilers) is characterized with a yield of about 30 vol %, an API of about 19, and a several fold reduction in viscosity over the initial feedstock. The product of the high boiler fraction, produced following the processing of the recycle fraction in the second stage, is typically characterized with a yield greater than about 75 vol %, and an API gravity of about 12, and a reduced viscosity over the feedstock recycled fraction. SimDist analysis for liquid product produced from heavy oil feedstock is characterized with approx. 7.4% (wt %) of the feedstock was distilled off below about 232° C. (Kerosene fraction v. 1.1% for the feedstock), approx. 18.9% from about 232° to about 327° C. (Diesel fraction v. 8.7% for the feedstock), and 21.7% evolved above 538Φ-78600 Λε Μεσνιλ λε ΡοιC (Vacuum resid fraction v. 51.5% for the feedstock; see Example 1 for complete analysis). SimDist analysis for liquid product produced from bitumen feedstock is characterized with approx. 10.6% (wt %) of the feedstock was distilled off below about 232° C. (Kerosene fraction v. 1.0% for the feedstock), approx. 19.7% from about 232° to about 327° C. (Diesel fraction v. 8.6% for the feedstock), and 19.5% evolved above 538° C. (Vacuum resid fraction v. 51.2% for the feedstock; see Example 2 for complete analysis).

Alternate conditions of a two stage process may include a first stage run where the feedstock is preheated to 150° C. and injected into the reactor with a residence time from about 0.01 to about 20 sec, preferably from about 0.01 to about 5 sec., or from about 0.01 to about 2 sec, and processed at about 530° to about 620° C., and with a residence time less than one second within the reactor (see FIG. 2). The product is collected using primary and secondary cyclones (100 and 180, respectively, FIGS. 2 and 4), and the remaining product is transferred to a hot condenser (250). The condensing system (FIG. 4) is engineered to selectively recover the heavy asphaltene components using a hot condenser (250) placed before the primary condenser (40). The heavy asphaltenes are collected and returned to the reactor (20) for further processing (i.e. the second stage). The second stage utilizes reactor conditions operating at higher temperatures, or longer residence times, or at higher temperatures and longer residence times (e.g. injection at a lower point in the reactor), than that used in the first stage to optimize the liquid product. Furthermore, a portion of the product stream may be recycled to extinction following this method.

Yet another modification of the composite and two stage processing systems, termed "multi-stage" processing, comprises introducing the primary feedstock (raw feed) into the the product vapours within the primary condenser or a fractionation column. Product drawn from the primary condenser, is then recycled to the reactor via line 270 for combined "first stage" and "second stage" processing (i.e. recycled processing). In an alternate embodiment, the primary condenser or fractionation column may used to separate a gaseous component of the primary feedstock from a liquid component of the primary feedstock, and the liquid component of the primary feedstock, and liquid product derived from processed feedstock present within the condenser or fractionation column, is transported to the upflow reactor, where it is subjected to rapid thermal processing. In an embodiment of this multi-stage processing, the primary feedstock may be combined with the calcium compound before being introduced into the primary condenser or fractionation column. The calcium compound may also be added to the sand reheater (30), for example within lines coming from the cyclone separators, 290 or 300, that recycle sand and coke to the sand reheater. CaO H2O or $Ca(OH)_2$ may be added directly to the sand reheater Multi-stage processing achieves high conversions of the resid fraction and upgrades the product liquid quality (such as its viscosity) more than it would be achievable via a single or two stage processing. The recycled feedstock is exposed to conditions that mildly crack the hydrocarbon components in order to avoid overcracking and excess gas and coke production. An example of these conditions includes, but is not limited to, injecting the feedstock at about 150° C. into a hot gas stream comprise the heat carrier at the inlet of the reactor. The feedstock is processed with a residence time of less than about two seconds within the reactor at a temperature of between about 450° C. to about 600° C. Preferably, the residence time is from about 0.8 to about 1.3 sec., and the reactor temperature is from about 480° C. to about 550° C. The product, comprising lighter materials (low boilers) is separated (100, and 180, FIG. 5), and removed in the condensing system (40). The heavier materials (240), separated out at the bottom of the condenser (40) are collected and reintroduced into the reactor (20) via line 270. Product gasses that exit the primary condenser (40) enter the secondary condenser (50) where a liquid product of reduced viscosity and high yield (300) is collected (see Example 5 for run analysis using this method). With multi-stage processing, the feedstock is recycled through the reactor in order to produce a product that can be collected from the second condenser, thereby upgrading and optimizing the properties of the liquid product.

Alternate feeds systems may also be used as required for one, two, composite or multi stage processing. For example, a primary heavy hydrocabon upgrading system, for example, FCC, viscracking, hydrocracking or other catalytic cracking processes, can be used as a front-end processing system to partially upgrade the feedstock. The rapid thermal processing system of the present invention can then be used to either further upgrade the product stream derived from the front-end system, or used to upgrade vacuum resid fractions, bottom fractions, or other residual refinery fractions, as known in the art, that are derived from the front-end system (FCC, viscracking, hydrocracking or other catalytic cracking processes), or both.

Therefore, the present invention also provides a method for processing a heavy hydrocarbon feedstock, as outlined in FIG. 5, where the feedstock (primary feedstock or raw feed) is obtained from the feed system (10), and is transported within line (280; which may be heated as previously described) to a primary condenser (40) or a fractionation column. The primary product obtained from the primary condenser/fractionation column may also be recycled back to the reactor (20) within a primary product recycle line (270). The primary product recycle line may be heated if required, and may also comprise a pre-heater unit (290) as shown in FIG. 5, to re-heat the recycled feedstock to desired temperature for introduction within the reactor (20). The calcium compound described above may be added to the feedstock prior to introduction into the condensing column or fractionation column, or it may be added prior to entry to the reactor. In a preferred embodiment, the calcium compound is added to a feedstock before it is introduced into the base of a fractionation column.

Following the recycle process as outlined above and graphically represented in FIG. 5, product with yields of greater than 60, and preferably above 75% (wt %), and with the following characteristics, which are not to be considered limiting in any manner, may be produced from either bitumen or heavy oil feedstocks: an API from about 14 to about 19; viscosity of from about 20 to about 100 (cSt @40° C.); and a low metals content (see Example 5).

From SimDist analysis, liquid products obtained following multi-stage processing of heavy oil can be characterized by comprising at least one of the following properties:

- having less than 50% of their components evolving at temperatures above 538° C. (vacuum resid fraction);
- comprising from about 60% to about 95% of the product evolving below 538°. Preferably, from about 70% to about 90%, and more preferably from about 75 to about 87% of the product evolves during Simulated Distillation below 538° C. (i.e. before the vacuum resid. fraction);
- having from about 1.0% to about 6% of the liquid product evolve below 193° C. Preferably from about 1.2% to about 5%, and more preferably from about 1.3% to about 4.8% evolves below 193° C. (i.e. before the naphtha/kerosene fraction);
- having from about 2% to about 6% of the liquid product evolve between 193-232° C. Preferably from about 2.8% to about 5% evolves between 193-232° C. (diesel fraction);
- having from about 15% to about 25% of the liquid product evolve between 232-327° C. Preferably, from about18.9 to about 23.1% evolves between 232-327° C. (diesel fraction);
- having from about 8% to about 15% of the liquid product evolve between 327-360° C. Preferably, from about 8.8 to about 10.8% evolves between 327-360° C. (light VGO fraction);
- having from about 40% to about 60% of the liquid product evolve between 360-538° C. Preferably, from about 42 to about 55% evolves between 360-538° C. (Heavy VGO fraction);

The liquid product obtained from multi-stage processing of bitumen may be characterized as having at least one of the following properties:

- having less than 50% of their components evolving at temperatures above 538° C. (vacuum resid fraction);

comprising from about 60% to about 95% of the product evolving below 538°. Preferably, from about 60% to about 85% evolves during Simulated Distillation below 538° C. (i.e. before the vacuum resid fraction);

having from about 1.0% to about 8% of the liquid product evolve below 193° C. Preferably from about 1.5% to about 7% evolves below 193° C. (i.e. before the naphtha/kerosene fraction);

having from about 2% to about 6% of the liquid product evolve between 193-232° C. Preferably from about 2.5% to about 5% evolves between 193-232° C. (diesel fraction);

having from about 12% to about 25% of the liquid product evolve between 232-327° C. Preferably, from about 15 to about 20% evolves between 232-327° C. (diesel fraction);

having from about 5% to about 12% of the liquid product evolve between 327-360° C. Preferably, from about 6.0 to about 10.0% evolves between 327-360° C. (light VGO fraction);

having from about 40% to about 60% of the liquid product evolve between 360-538° C. Preferably, from about 35 to about 50% evolves between 360-538° C. (Heavy VGO fraction);

Collectively these results show that a substantial proportion of the components with low volatility in either of the feedstocks have been converted to components of higher volatility (light naphtha, kerosene and diesel) in the liquid product. These results demonstrate that the liquid product can be substantially upgraded to a quality suitable for transport by pipeline.

The present invention also provides for a method to decrease sulfur emissions within the flue gas during rapid thermal processing of heavy hydrocarbon feedstocks. Reduced $SO_2$ emissions may be obtained by adding lime, for example but not limited to $Ca(OH)_2$, CaO or CaOH to the feedstock oil prior to processing the feedstock. If moisture is available in the feedstock, CaO may be used on place of $Ca(OH)_2$, as CaO will be converted to $Ca(OH)_2$. A calcium compound, such as CaO $H_2O$ or $Ca(OH)_2$ may also be added to the sand reheater (30) to enhance flue gas desulfurization. For example, which is not to be considered limiting in any manner, adding lime to the sand reheater in an amount corresponding to a 1.7 fold stoichiometric requirement for sulfur in the coke entering the sand reheater (coke combustor) resulted in about a 95% flue gas desulfurization (see FIG. 6 and Examples 8A and B). The amount of the calcium compound to be added to the feedstock or sand reheater can be determined by assaying the level of sulfur emissions in the flue gas.

As shown in Table 18, Example 7A, addition of the calcium compound to the feedstock or the sand reheater did not alter the properties of the liquid product produced from the pyrolysis of a heavy hydrocarbon feedstock, for example, but not limited to, bitumen, in the absence of the calcium compound. Furthermore, addition of a calcium compound to the feedstock prior to or during rapid thermal processing reduces the TAN of the product (see Table 18, Example 7A, compare "Period 1, Feed", the TAN of the feedstock prior to calcium addition with "Period 3, Prod", the product following rapid thermal processing in the presence of a calcium compound). As shown in Table 19, Example 7B, addition of 3.0 wt. % of $Ca(OH)_2$ to the feedstock of a heavy oil from a San Ardo field (Bakersfield, Calif.) reduced the TAN value of the feedstock three fold relative to untreated feedstock, and resulted in liquid products having TAN values that were about 5 times less than the TAN value of the untreated feedstock. This reduction in the TAN value of the feedstock can extend the lifetime of the fast pyrolysis reactor, as well as the lifetime of other components within the processing system.

The addition of the calcium compound described above to the feedstock prior to or during rapid thermal processing also decreases the hydrogen sulfide content of one, or more than component of the product stream. As shown in Table 20, Example 9, the addition of 1.2 wt % of calcium in the form of a $Ca(OH)_2$ to a heavy hydrocarbon feedstock resulted in a quantitative reduction in the $H_2S$ content of the product gas. The specific amount of the calcium compound to be added to a given feedstock to completely remove hydrogen sulfide in components of the product stream can be determined by assaying the level of hydrogen sulfide present in the product stream following rapid pyrolysis in the absence of a calcium compound.

Therefore, the present invention also provides a method of reducing the hydrogen sulfide content of one, or more than one component of a product stream derived from rapid thermal processing of a heavy hydrocarbon feedstock, comprising:

(i) rapid thermal processing of the heavy hydrocarbon feedstock in the presence of a calcium compound;

(ii) rapid thermal processing of the heavy hydrocarbon feedstock in the presence of a calcium compound, and regeneration of a particulate heat carrier in a reheater in the presence of a calcium compound, or (iii) rapid thermal processing of the heavy hydrocarbon feedstock, and regeneration of a particulate heat carrier in a reheater in the presence of a calcium compound.

By reducing the TAN of the product, heavy oil feedstocks having a high TAN, such as the one derived from a San Ardo Field (Bakersfield, Calif. Example 7B), and that otherwise command a reduced market value due to their corrosive properties, this heavy oil product is now more suitable for further processing using upgrading systems known in the art, for example but not limited to FCC or other catalytic cracking procedures, visbreaking, or hydrocracking. Therefore, by processing a heavy hydrocarbon feedstock characterized as having a high TAN in the presence of calcium, upgrades the product and renders the product useful for a variety of further processing methods.

Figure 6:
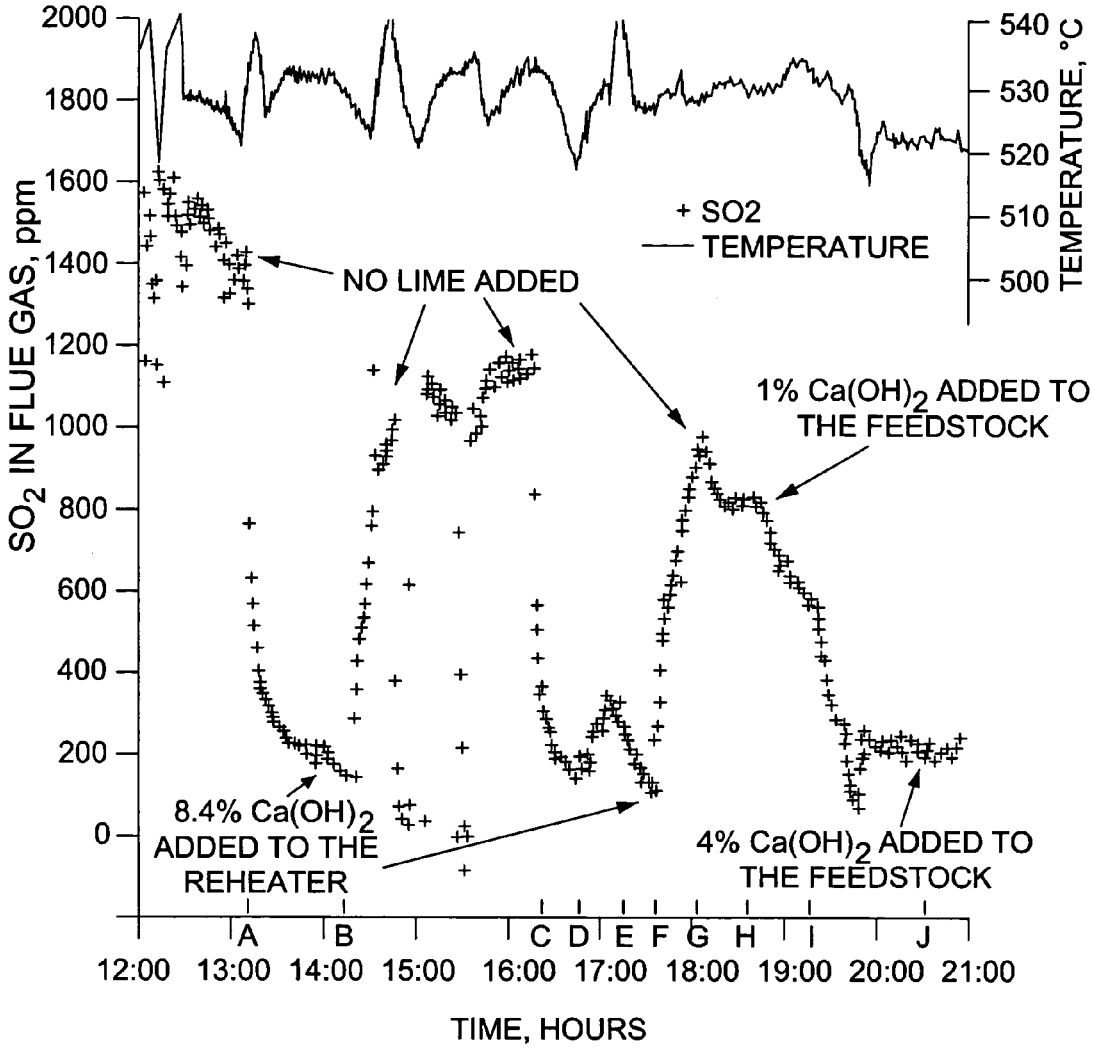
FIG. 6 is a graph of (i) the values of concentration (ppm) of $SO_2$ in flue gas derived from a sand reheater used in an example of an embodiment of the present invention, and (ii) the values of temperature (° C.) of the sand reheater, both measured as a function of time (hours). The values of concentration of $SO_2$ and the temperature of the sand reheater were measured during the processing a bitumen feedstock, in the presence or absence of $Ca(OH)_2$. See text for definitions of the time intervals marked A to J.
Figure 7:
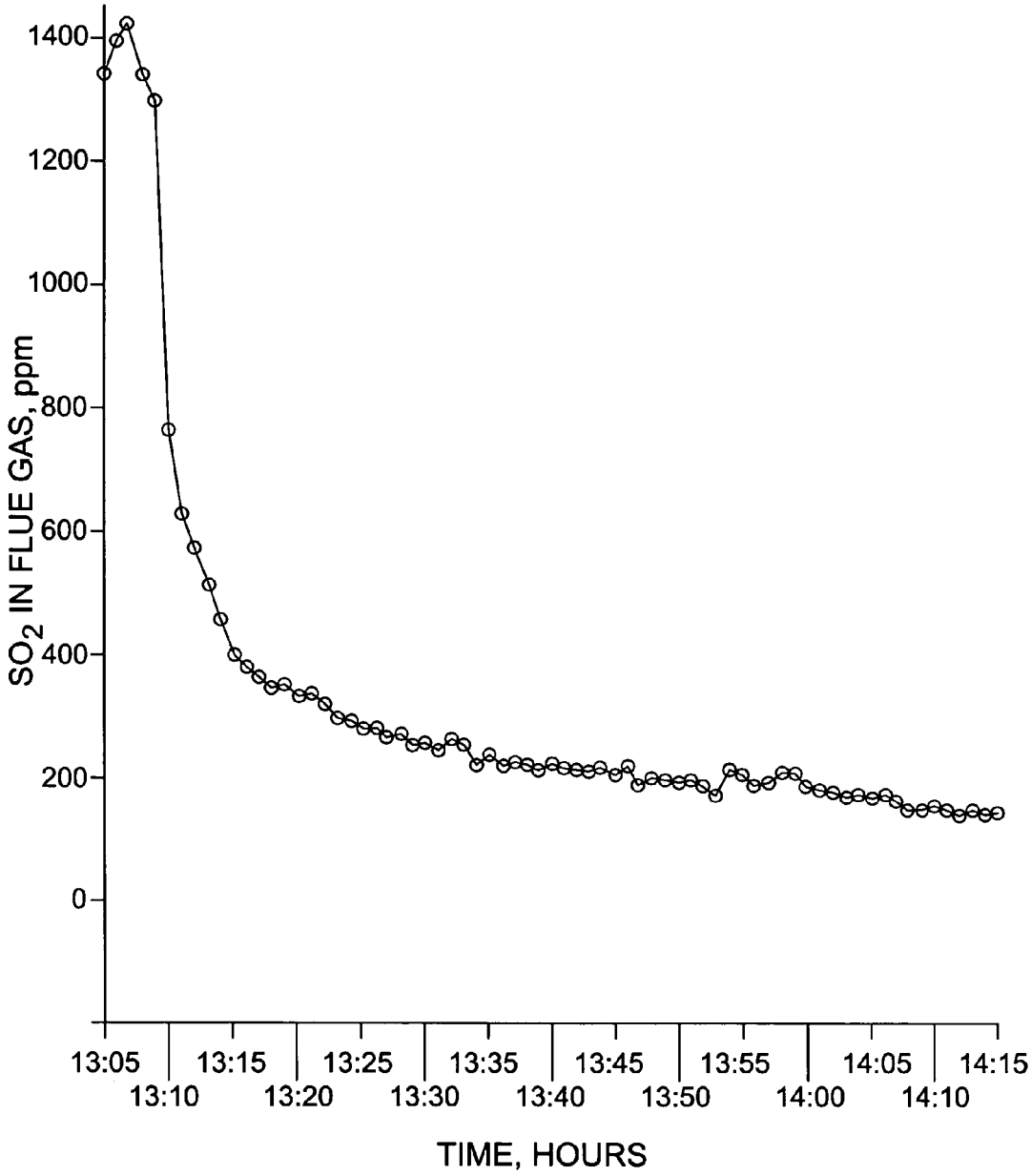
FIG. 7 is an enlargement of the graph of FIG. 6, from the period between 13:05 hour to 14:15 hour.

FIGS. 6 and 7 show the changes in the value of $SO_2$ in the flue gas over time during the processing of a bitumen oil feedstock, as $Ca(OH)_2$ is added to the sand reheater or the feedstock line. The starting points of $Ca(OH)_2$ addition within the sand reheater are denoted as points A, C, E, (FIG. 6), and the starting points of $Ca(OH)_2$ addition to the feedstock are denoted as points G, H and I (FIG. 6). At point A, calcium (8.4 wt % per feed) was added to the sand reheater, and stopped at B. $Ca(OH)_2$ was re-added at C (8.4 wt %), and stopped again at D, re-added at a lower concentration (6.6 wt %) at E and stopped again at F. At G, $Ca(OH)_2$ (1% wt per feed) was added to the feedstock, followed by a $Ca(OH)_2$ addition at 2 wt % at H, and 4 wt % at I. As can be seen, the $SO_2$ levels responded to the various discontinued $Ca(OH)_2$ additions. The results demonstrate that additions of $Ca(OH)_2$ to either the sand reheater or the feedstock were effective in reducing $SO_2$ levels in the flue gas. Additions of calcium to the feedstock required less $Ca(OH)_2$ to achieve the same $SO_2$ reduction in the flue gas.

After stopping calcium addition to either the sand reheater or feedstock, the delays in reaching baseline sulfur levels within the flue gas decreased when compared to the start of the experiment (compare $SO_x$ levels prior to A and those between B and C, or at about G). This decrease in emission may be due to recycling of the $Ca(OH)_2$ along with the particulate heat carrier through the system. When being recycled, the calcium may also function as a heat carrier. If $Ca(OH)_2$ is recycled along with the particulate heat carrier, then a portion of the $Ca(OH)_2$ may be removed periodically if new $Ca(OH)_2$ is added to the feedstock. If desired, the $Ca(OH)_2$ can be separated from the particulate heat carrier as required.

FIG. 7 shows the time course over the first hour following $Ca(OH)_2$ addition to the sand reheater of the experiment illustrated in FIG. 6, and the associated rapid decrease in $SO_x$. The amount of $Ca(OH)_2$ added at 13:09, is about 70% of the feed stoichiometric amount of sulfur whereas it is about 1.7 to 2 fold stoichiometric amount of sulfur entering the reheater. In the absence of $Ca(OH)_2$, in the system, the initial $SO_2$ concentration in the flue gas was about 1400 ppm. Once the $Ca(OH)_2$ injections into the sand reheater (fluidized bed) began at 13:09, the $SO_2$ levels decreased rapidly. The rapid reduction of $SO_2$ to about 85% was followed by a more gradual reduction, to a final value of about 95% reduction in $SO_2$.

Figure 8:
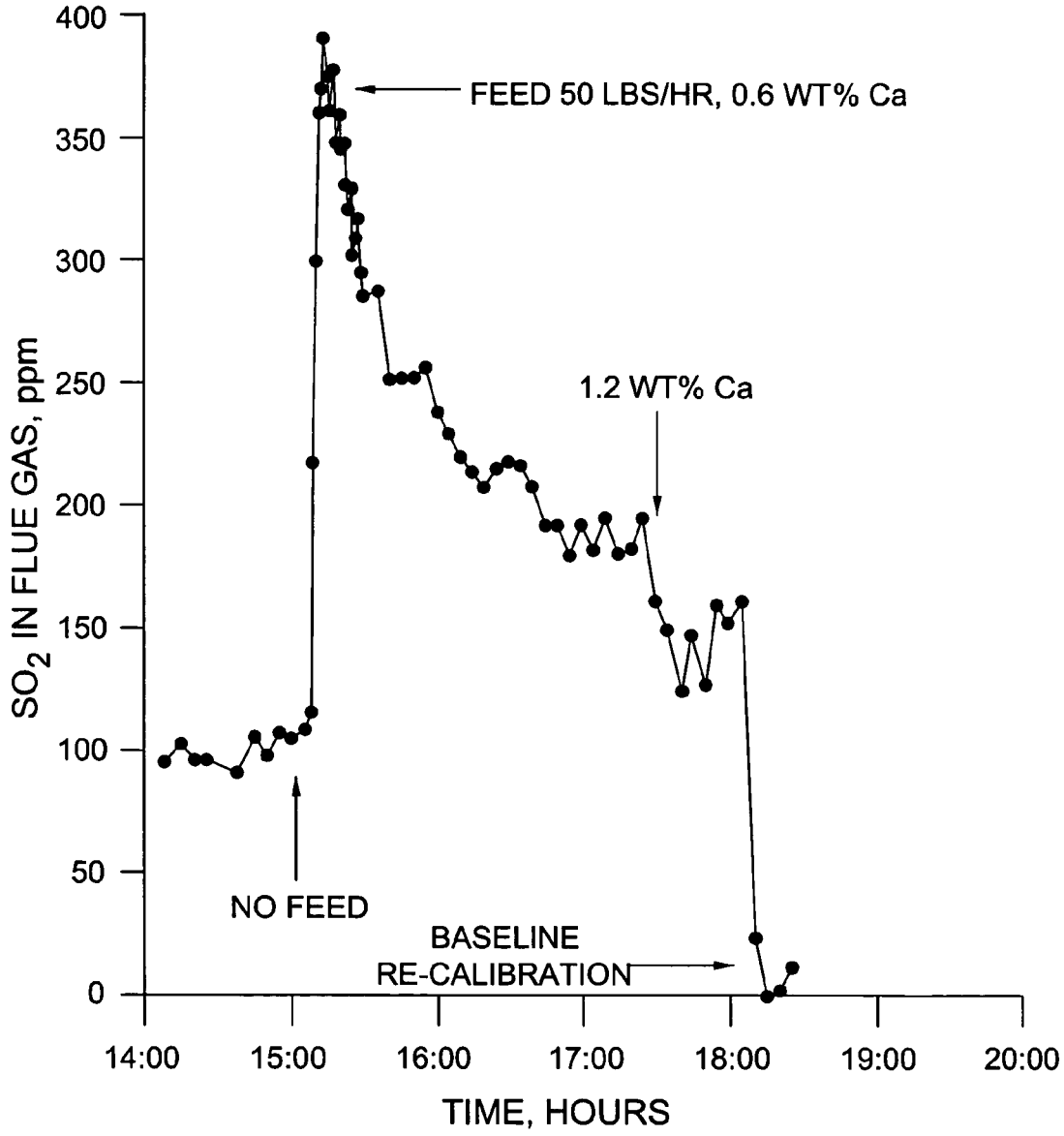
FIG. 8 shows a graph of the change in the concentration (ppm) of $SO_2$ in flue gas derived from a sand reheater used in an example of an embodiment of the present invention, over time. The values of concentration of $SO_2$ were measured during the processing of a San Ardo heavy oil feed (obtained from Bakersfield, Calif.), in the presence of $Ca(OH)_2$.

FIG. 8 shows changes in the value of $SO_2$ in the flue gas over during processing of a heavy oil feedstock derived from a San Ardo field (Bakersfield, Calif.), as $Ca(OH)_2$ is added to the feedstock. In the absence of $Ca(OH)_2$, in the system, the initial $SO_2$ concentration in the flue gas was about 500 ppm. Once the $Ca(OH)_2$ was added to the feedstock (e.g. at 15:20), the $SO_2$ level decreased rapidly to approximately 50% of the initial value. Continued reduction in $SO_2$ is noted with additional addition of calcium.

Therefore, the present invention provides a method for (i) reducing $SO_x$ emissions in flue gas, (ii) reducing total acid number (TAN) in a liquid product, (iii) reducing the $H_2S$ content in a liquid product, or a combination thereof, during upgrading of a heavy hydrocarbon feedstock comprising rapid thermal processing of the heavy hydrocarbon feedstock in the presence of a calcium compound.

Furthermore, the present invention provides a method for rapid thermal processing a heavy hydrocarbon feedstock in the presence of a calcium compound comprising, i) providing a particulate heat carrier into an upflow reactor;

ii) introducing the heavy hydrocarbon feedstock into the upflow reactor so that a loading ratio of the particulate heat carrier to the heavy hydrocarbon feedstock is from about 10:1 to about 200:1;

iii) allowing the heavy hydrocarbon feedstock to interact with said heat carrier with a residence time of less than about 5 seconds, to produce a product stream;

iv) separating the product stream from the particulate heat carrier; and v) collecting a gaseous (first) and liquid (second) product from the product stream.

wherein the calcium compound is added at steps i), ii), iii), iv), v), or a combination thereof, at an amount from about at 0.2 to 5 fold the stoichiometric amount of sulfur in the feedstock.

The above description is not intended to limit the claimed invention in any manner, furthermore, the discussed combination of features might not be absolutely necessary for the inventive solution.

The present invention will be further illustrated in the following examples. However, it is to be understood that these examples are for illustrative purposes only, and should not to be used to limit the scope of the present invention in any manner.

EXAMPLE 1

Heavy Oil (Single Stage)

Pyrolytic processing of Saskatchewan Heavy Oil and Athabasca Bitumen (see Table 1) were carried out over a range of temperatures using a pyrolysis reactor as described in U.S. Pat. No. 5,792,340.

TABLE 1

Characteristics of heavy oil and bitumen feedstocks

| Compound | Heavy Oil[1)] | Bitumen[2)] |
|---|---|---|
| Carbon (wt %) | 84.27 | 83.31 |
| Hydrogen (wt %) | 10.51 | 10.31 |
| Nitrogen (wt %) | <0.5 | <0.5 |
| Sulphur (st %) | 3.6 | 4.8 |
| Ash (wt %) | 0.02 | 0.02 |
| Vanadium (ppm) | 127 | 204 |
| Nickel (ppm) | 43 | 82 |
| Water content (wt %) | 0.8 | 0.19 |
| Gravity API° | 11.0 | 8.6 |
| Viscosity @ 40° C. (cSt) | 6500 | 40000 |
| Viscosity @ 60° C. (cSt) | 900 | 5200 |
| Viscosity @ 80° C. (cSt) | 240 | 900 |
| Aromaticity (C13 NMR) | 0.31 | 0.35 |

[1)]Saskatchewan Heavy Oil
[2)]Athabasca Bitumen (neat)

Briefly the conditions of processing include a reactor temperature from about 500° to about 620° C. Loading ratios for particulate heat carrier (silica sand) to feedstock of from about 20:1 to about 30:1 and residence times from about 0.35 to about 0.7 sec. These conditions are outlined in more detail below (Table 2).

TABLE 2

Single stage processing of Saskatchewan Heavy Oil

| Reactor Temp ° C. | Viscosity @ 40° C. (cSt) | Yield wt % | Density @ 15° g/ml | API° | Yield Vol % |
|---|---|---|---|---|---|
| 620 | 4.6[1)] | 71.5 | 0.977 | 13.3 | 72.7 |
| 592 | 15.2[1)] | 74.5 | 0.970 | 14.4 | 76.2 |
| 590 | 20.2 | 70.8 | 0.975 | 13.6 | 72.1 |
| 590 | 31.6 | 75.8 | 0.977 | 13.3 | 77.1 |
| 560 | 10.0[1)] | 79.9[2)] | 0.963 | 15.4 | 82.3[2)] |
| 560 | 10.0[1)] | 83.0[3)] | 0.963 | 16.2[3)] | 86.3[3)] |
| 550 | 20.8 | 78.5 | 0.973 | 14.0 | 80.3 |
| 550[4)] | 15.7 | 59.8[2)] | 0.956 | 16.5 | 61.5[2)] |
| 550[4)] | 15.7 | 62.0[3)] | 0.956 | 18.3[2,3] | 65.1[3)] |
| 530 | 32.2 | 80.9[2)] | 0.962 | 15.7 | 82.8[2)] |
| 530 | 32.2 | 83.8[3)] | 0.962 | 16.6[3)] | 87.1[3)] |

[1)]Viscosity @ 80° C.
[2)]Yields do not include overhead condensing
[3)]Estimated yields and API with overhead condensing
[4)]Not all of the liquids were captured in this trial.

The liquid products of the runs at 620° C., 592° C. and 560° C. were analysed for metals, water and sulphur content. These results are shown in Table 3. Nickel, Vanadium and water levels were reduced 72, 69 and 87%, respectively, while sulphur and nitrogen remained the same or were marginally reduced. No metals were concentrated in the liquid product.

TABLE 3

| Metal Analysis of Liquid Products (ppm)[1)] | | | | |
|---|---|---|---|---|
| Component | Saskatchewan Heavy Oil | Run @ 620° C. | Run @ 592° C. | Run @ 560° C. |
| Aluminum | <1 | <1 | 11 | <1 |
| Iron | <1 | 2 | 4 | <1 |
| Nickel | 44 | 10 | 12 | 9 |
| Zinc | 2 | <1 | 2 | 1 |
| Calcium | 4 | 2 | 3 | 1 |
| Magnesium | 3 | 1 | 2 | <1 |
| Boron | 21 | 42 | 27 | <1 |
| Sodium | 6 | 5 | 5 | 4 |
| Silicon | 1 | 10 | 140 | 4 |
| Vanadium | 127 | 39 | 43 | 39 |
| Potassium | 7 | 7 | <1 | 4 |
| Water(wt %) | 0.78 | 0.19 | 0.06 | .10 |
| Sulphur (wt %) | 3.6 | 3.5 | 3.9 | 3.5 |

[1)]Copper, tin, chromium, lead, cadmium, titanium, molybdenum, barium and manganese all showed less than 1 ppm in feedstock and liquid products.

The gas yields for two runs are presented in Table 4.

TABLE 4

| Gas analysis of Pyrolysis runs | | |
|---|---|---|
| Gas (wt %) | Run @ 620° C. | Run @ 560° C. |
| Total Gas Yield | 11.8 | 7.2 |
| Ethylene | 27.0 | 16.6 |
| Ethane | 8.2 | 16.4 |
| Propylene | 30.0 | 15.4 |
| Methane | 24.0 | 21.0 |

The pour point of the feedstock improved and was reduced from 32° F. to about −54° F. The Conradson carbon reduced from 12. wt % to about 6.6 wt %.

Based on the analysis of these runs, higher API values and product yields were obtained for reactor temperatures of about 530 to about 560° C. At these temperatures, API gravities of 14 to 18.3, product yields of from about 80 to about 87 vol %, and viscosities of from about 15 to about 35 cSt (@40° C.) or about 10 cST (@80° C.) were obtained (the yields from the 550° C. run are not included in this range as the liquid yield capture was not optimized during this run). These liquid products reflect a significant degree of upgrading, and exhibit qualities suitable for pipeline transport.

Simulated distillation (SimDist) analysis of feedstock and liquid product obtained from several separate runs is given in Table 5. SimDist analysis followed the protocol outlined in ASTM D 5307-97, which reports the residue as anything with a boiling point higher than 538° C. Other methods for SimDist may also be used, for example HT 750 (NCUT; which includes boiling point distribution through to 750° C.). These results indicate that over 50% of the components within the feedstock evolve at temperatures above 538° C. These are high molecular weight components with low volatility. Conversely, in the liquid product, the majority of the components, approx 62.1% of the product are more volatile and evolve below 538° C.

TABLE 5

| SimDist analysis of feedstock and liquid product after single stage processing (Reactor temp 538° C.) | | | |
|---|---|---|---|
| Fraction | Temp (° C.) | Feedstock | R245 |
| Light Naphtha | <71 | 0.0 | 0.5 |
| Light/med Naphtha | 71-100 | 0.0 | 0.3 |
| Med Naphtha | 100-166 | 0.0 | 1.4 |
| Naphtha/Kerosene | 166-193 | 0.1 | 1.0 |
| Kerosene | 193-232 | 1.0 | 2.8 |
| Diesel | 232-327 | 8.7 | 14.2 |
| Light VGO | 327-360 | 5.2 | 6.5 |
| Heavy VGO | 360-538 | 33.5 | 35.2 |
| Vacuum Resid. | >538 | 51.5 | 37.9 |

The feedstock can be further characterized with approx. 0.1% of its components evolving below 193° C. (naphtha/kerosene fraction), v. approx. 6% for the liquid product. The diesel fraction also demonstrates significant differences between the feedstock and liquid product with 8.7% and 14.2% evolving at this temperature range (232-327° C.), respectively. Collectively these results show that a substantial proportion of the components with low volatility in the feedstock have been converted to components of higher volatility (light naphtha, kerosene and diesel) in the liquid product.

Stability of the liquid product was also determined over a 30 day period (Table 6). No significant change in the viscosity, API or density of the liquid product was observed of a 30 day period.

TABLE 6

| Stability of liquid products after single stage processing | | | | |
|---|---|---|---|---|
| Fraction | Time = 0 | 7 days | 14 days | 30 days |
| Density @ 15.6° C. (g/cm$^3$) | 0.9592 | 0.9590 | 0.9597 | 0.9597 |
| API (deg. API) | 15.9 | 15.9 | 15.8 | 15.8 |
| Viscosity @ 40° C. (cSt) | 79.7 | 81.2 | 81.2 | 83.2 |

EXAMPLE 2

Bitumen (Single Stage)

Several runs using Athabasca Bitumen were conducted using the pyrolysis reactor described in U.S. Pat. No. 5,792,340. The conditions of processing included a reactor temperature from 520° to about 590° C. Loading ratios for particulate heat carrier to feedstock of from about 20:1 to about 30:1, and residence times from about 0.35 to about 1.2 sec. These conditions, and the resulting liquid products are outlined in more detail below (Table 7).

TABLE 7

| Single Stage Processing with Undiluted Athabasca Bitumen | | | | | | |
|---|---|---|---|---|---|---|
| Crack Temp | Viscosity @ 40° C. (cSt) | Yield wt % | Density @ 15° C. | Metals V (ppm)* | Metals Ni (ppm)** | API |
| 519° C. | 205 | 81.0 | nd | nd | nd | 13.0 |
| 525° C. | 201 | 74.4 | 0.979 | 88 | 24 | 12.9 |
| 528° C. | 278 | 82.7 | nd | nd | nd | 12.6 |
| 545° C. | 151 | 77.4 | 0.987 | 74 | 27 | 11.8 |
| 590° C. | 25.6 | 74.6 | 0.983 | nd | nd | 12.4 |

*feedstock V 209 ppm
**feedstock Ni 86 ppm

These results indicates that undiluted bitumen may be processed according to the method of this invention to produce a liquid product with reduced viscosity from greater than 40000 cSt (@40° C.) to about 25.6-200 cSt (@40° C. (depending on the run conditions; see also Tables 8 and 9), with yields of over 75% to about 85%, and an improvement in the product API from 8.6 to about 12-13. Again, as per Example 1, the liquid product exhibits substantial upgrading of the feedstock. SimDist analysis,and other properties of the liquid product are presented in Table 8, and stability studies in Table 9.

TABLE 8

Properties and SimDist analysis of feedstock and liquid product after single stage processing (Reactor temp. 545° C.).

| | | | R239 | |
|---|---|---|---|---|
| Fraction | Temp (° C.) | Feedstock | 14 days | 30 days |
| Density @ 15.5° C. | — | | 0.9871 | 0.9876 |
| API | — | | 11.7 | 11.6 |
| Viscosity @ 40° C. | — | | 162.3 | 169.4 |
| Light Naphtha | <71 | 0.0 | 0.2 | 0.1 |
| Light/med Naphtha | 71-100 | 0.0 | 0.2 | 0.2 |
| Med Naphtha | 100-166 | 0.0 | 1.5 | 1.4 |
| Naphtha/Kerosene | 166-193 | 0.1 | 1.0 | 1.0 |
| Kerosene | 193-232 | 0.9 | 3.1 | 3.0 |
| Diesel | 232-327 | 8.6 | 15.8 | 14.8 |
| Light VGO | 327-360 | 5.2 | 7.9 | 7.6 |
| Heavy VGO | 360-538 | 34.0 | 43.9 | 42.0 |
| Vacuum Resid. | >538 | 51.2 | 26.4 | 29.9 |

TABLE 9

Stabilty of liquid products after single stage processing (reactor temperature 525° C.)

| | Temp | R232 | | | | |
|---|---|---|---|---|---|---|
| Fraction | (° C.) | Feedstock | day 0 | 7 days | 14 days | 30 days |
| Density @ 15.6° C.* | — | 1.0095 | 0.979 | 0.980 | 0.981 | 0.981 |
| API | — | 8.5 | 12.9 | 12.7 | 12.6 | 12.6 |
| Viscosity @ 40° C.** | — | 30380 | 201.1 | 213.9 | 214.0 | 218.5 |
| Light Naphtha | <71 | 0.0 | 0.1 | 0.1 | 0.1 | 0.1 |
| Light/med Naphtha | 71-100 | 0.0 | 0.1 | 0.1 | 0.1 | 0.1 |
| Med Naphtha | 100-166 | 0.0 | 1.5 | 1.5 | 1.5 | 1.4 |
| Naphtha/Kerosene | 166-193 | 0.1 | 1.0 | 1.0 | 1.0 | 1.1 |
| Kerosene | 193-232 | 1.0 | 2.6 | 2.6 | 2.6 | 2.7 |
| Diesel | 232-327 | 8.7 | 14.1 | 14.1 | 14.3 | 14.3 |
| Light VGO | 327-360 | 5.2 | 7.3 | 7.3 | 7.4 | 7.4 |
| Heavy VGO | 360-538 | 33.5 | 41.3 | 41.3 | 41.7 | 42.1 |
| Vacuum Resid. | >538 | 51.5 | 32.0 | 32.0 | 31.2 | 30.8 |

*g./cm$^3$
**cSt

The slight variations in the values presented in the stability studies (Table 9 and other stability studies disclosed herein) are within the error of the test methods employed, and are acceptable within the art. These results demonstrate that the liquid products are stable.

These results indicate that over 50% of the components within the feedstock evolve at temperatures above 538° C. (vacuum resid fraction). This fraction is characterized by high molecular weight components with low volatility. Conversely, over several runs, the liquid product is characterized as comprising approx 68 to 74% of the product that are more volatile and evolve below 538° C. The feedstock can be further characterized with approx. 0.1% of its components evolving below 193° C. (naphtha/kerosene fraction), v. approx. 2.7 to 2.9% for the liquid product. The diesel fraction also demonstrates significant differences between the feedstock and liquid product with 8.7% (feedstock) and 14.1 to 15.8% (liquid product) evolving at this temperature range (232-327° C.). Collectively these results show that a substantial proportion of the components with low volatility in the feedstock have been converted to components of higher volatility (light naphtha, kerosene and diesel) in the liquid product. These results demonstrate that the liquid product is substantially upgraded, and exhibits properties suitable for transport.

EXAMPLE 3

Composite/Recycle of Feedstock

The pyrolysis reactor as described in U.S. Pat. No. 5,792,340 may be configured so that the recovery condensers direct the liquid products into the feed line to the reactor (see FIGS. 3 and 4).

The conditions of processing included a reactor temperature ranging from about 530° to about 590° C. Loading ratios for particulate heat carrier to feedstock for the initial and recycle run of about 30:1, and residence times from about 0.35 to about 0.7 sec were used. These conditions are outlined in more detail below (Table 10). Following pyrolysis of the feedstock, the lighter fraction was removed and collected using a hot condenser placed before the primary condenser (see FIG. 4), while the heavier fraction of the liquid product was recycled back to the reactor for further processing (also see FIG. 3). In this arrangement, the recycle stream (260) comprising heavy fractions was mixed with new feedstock (270) resulting in a composite feedstock (240) which was then processed using the same conditions as with the initial run within the pyrolysis reactor.

TABLE 10

Composite/Recycle operation using Saskatchewan Heavy Crude Oil and Undiluted Athabasca Bitumen

| Feedstock | Crack Temp ° C. | Yield Vol % | API° | Recycle[4)] Yield vol % | Recycle[4)] API° |
|---|---|---|---|---|---|
| Heavy Oil | 590 | 77.1[1)] | 13.3 | 68.6 | 17.1 |
| | 560 | 86.3[2)] | 16.2 | 78.1 | 21.1 |
| | 550 | 50.1[1)] | 14.0 | 71.6 | 17.8 |
| | 550 | 65.1[2,3)] | 18.3 | 56.4 | 22.9 |
| | 530 | 87.1[2)] | 16.6 | 78.9 | 21.0 |
| Bitumen | 590 | 75.2[2)] | 12.4 | 67.0 | 16.0 |

[1)]Yield and API gravity include overhead condensing (actual)
[2)]Yield and API gravity include overhead condensing (estimated)
[3)]Not all of the liquid was recovered in this run
[4)]These values represent the total recovery of product following the recycle run, and presume the removal of approximately 10% heavy fraction which is recycled to extinction. This is therefore a conservative estimate of yield as some of the heavy fraction will produce lighter components that enter the product stream, since not all of the heavy fraction will end up as coke.

The API gravity increased from 11.0 in the heavy oil feedstock to about 13 to about 18.5 after the first treatment cycle, and further increases to about 17 to about 23 after a second recycle treatment. A similar increase in API is observed for bitumen having a API of about 8.6 in the feedstock, which increase to about 12.4 after the first run and to 16 following the recycle run. With the increase in API, there is an associated increase in yield from about 77 to about 87% after the first run, to about 67 to about 79% following the recycle run. Therefore associated with the production of a lighter product, there is a decrease in liquid yield. However, an upgraded lighter product may be desired for transport, and recycling of liquid product achieves such a product.

EXAMPLE 4

Two-Stage Treatment of Heavy Oil

Heavy oil or bitumen feedstock may also be processed using a two-stage pyrolytic process which comprises a first stage where the feedstock is exposed to conditions that mildly crack the hydrocarbon components in order to avoid overcracking and excess gas and coke production. Lighter materials are removed following the processing in the first stage, and the remaining heavier materials are subjected to a more severe crack at a higher temperature. The conditions of processing within the first stage include a reactor temperature ranging from about 510 to about 530° C. (data for 515° C. given below), while in the second stage, a temperature from about 590° to about 800° C. (data for 590° C. presented in table 11) was employed. The loading ratios for particulate heat carrier to feedstock range of about 30:1, and residence times from about 0.35 to about 0.7 sec for both stages. These conditions are outlined in more detail below (Table 11).

TABLE 11

Two-Stage Runs of Saskatchewan Heavy Oil

| Crack Temp. ° C. | Viscosity @ 80° C. (cSt) | Yield wt % | Density @ 15 EC g/ml | API° | Yield Vol %[1)] |
|---|---|---|---|---|---|
| 515 | 5.3 | 29.8 | 0.943 | 18.6 | 31.4 |
| 590 | 52.6 | 78.9 | 0.990 | 11.4 | 78.1 |
| 515 & 590 | nd | nd | nd | 13.9 | 86.6 |

"nd" means not determined
[1)]Light condensible materials were not captured. Therefore these values are conservative estimates.

These results indicate that a mild initial crack which avoids overcracking light materials to gas and coke, followed by a more severe crack of the heavier materials produces a liquid product characterized with an increased API, while still exhibiting good product yields.

Other runs using a two stage processes, involved injecting the feedstock at about 150° C. into a hot gas stream maintained at about 515° C. and entering the reactor at about 300° C. (processing temperature). The product, comprising lighter materials (low boilers) was separated and removed following the first stage in the condensing system. The heavier materials, separated out at the bottom of the cyclone were collected subjected to a more severe crack within the reactor in order to render a liquid product of reduced viscosity and high yield. The conditions utilized in the second stage were a processing temperature of between about 530° to about 590° C. Product from the second stage was processed and collected.

Following such a two stage process the product of the first stage (light boilers) is characterized with a yield of about 30 vol %, an API of about 19, and a several fold reduction in viscosity over the initial feedstock. The product of the high boiling point fraction, produced following the processing of the recycle fraction in the second stage, is typically characterized with a yield greater than about 75 vol %, and an API gravity of about 12, and a reduced viscosity over the feedstock recycled fraction.

EXAMPLE 5

"Multi-Stage" Treatment of Heavy Oil and Bitumen, Using Feedstock for Quenching within Primary Condenser Heavy oil or bitumen feedstock may also be processed using a "Multi-stage" pyrolytic process as outlined in FIG. 5. In this system, the pyrolysis reactor described in U.S. Pat. No. 5,792,340 is configured so that the primary recovery condenser directs the liquid product into the feed line back to the reactor, and feedstock is introduced into the system at the primary condenser where it quenches the product vapours produced during pyrolysis.

The conditions of processing included a reactor temperature ranging from about 530° to about 590° C. Loading ratios for particulate heat carrier to feedstock for the initial and recycle run of from about 20:1 to about 30:1, and residence times from about 0.35 to about 1.2 sec were used. These conditions are outlined in more detail below (Table 12). Following pyrolysis of the feedstock, the lighter fraction is forwarded to the secondary condenser while the heavier fraction of the liquid product obtained from the primary condenser is recycled back to the reactor for further processing (FIG. 5).

TABLE 12

Characterization of the liquid product obtained following Multi-Stage processing of Saskatchewan Heavy Oil and Bitumen

| Crack Temp. ° C. | Viscosity @ 40° C. (cSt) | Yield wt % | Density @ 15.6° C. g/ml | API° | Yield Vol % 1) |
|---|---|---|---|---|---|
| Heavy Oil | | | | | |
| 543 | 80 | 62.6 | 0.9592 | 15.9 | 64.9 |
| 557 | 24 | 58.9 | 0.9446 | 18.2 | 62.1 |
| 561 | 53 | 70.9 | 0.9568 | 16.8 | 74.0 |
| Bitumen | | | | | |
| 538 | 40 | 61.4 | 0.9718 | 14.0 | 71.1 |

The liquid products produced from multi-stage processing of feedstock exhibit properties suitable for transport with greatly reduced viscosity down from 6343 cSt (@40° C.) for heavy oil and 30380 cSt (@40° C.) for bitumen. Similarly, the API increased from 11 (heavy oil) to from 15.9 to 18.2, and from 8.6 (bitumen) to 14.7. Furthermore, yields for heavy oil under these reaction conditions are from 59 to 68% for heavy oil, and 82% for bitumen.

TABLE 13

Properties and SimDist of liquid products prepared from Heavy Oil using the multi-stage Process (for feedstock properties see Tables 1 and 5).

| Fraction | Temp (° C.) | R241* Day 0 | R241* Day 30 | R242** Day 30 | R244*** |
|---|---|---|---|---|---|
| Density @ 15.6° C. | — | 0.9592 | 0.9597 | 0.9465 | 0.9591 |
| API | — | 15.9 | 15.8 | 17.8 | 15.9 |
| Viscosity @ 40° C. | — | 79.7 | 83.2 | 25.0 | 49.1 |
| Light Naphtha | <71 | 0.0 | 0.2 | 0.3 | 0.3 |
| Light/med Naphtha | 71-100 | 0.0 | 0.1 | 0.2 | 0.3 |
| Med Naphtha | 100-166 | 0.1 | 0.4 | 2.5 | 1.8 |
| Naphtha/Kerosene | 166-193 | 0.6 | 0.6 | 1.8 | 1.5 |
| Kerosene | 193-232 | 2.8 | 2.5 | 5.0 | 3.5 |
| Diesel | 232-327 | 21.8 | 21.0 | 23.1 | 18.9 |
| Light VGO | 327-360 | 10.8 | 10.2 | 9.9 | 8.8 |
| Heavy VGO | 360-538 | 51.1 | 45.0 | 44.9 | 43.2 |
| Vacuum Resid. | >538 | 12.7 | 20.0 | 12.3 | 21.7 |

*reactor temp. 543° C.
**reactor temp. 557° C.
***reactor temp. 561° C.

Under these run conditions the API increased from 11 to about 15.9 to 17.8. Product yields of 62.6 (wt %; R241), 58.9 (wt %; R242) and 70.9 (wt %; R244) were achieved along with greatly reduced viscosity levels. These liquid products have been substantially upgraded over the feedstock and exhibit properties suitable for pipeline transport.

SimDist results indicate that over 50% of the components within the feedstock evolve at temperatures above 538° C. (vacuum resid fraction), while the liquid product is characterized as comprising approx 78 to 87% of the product that are more volatile and evolve below 538° C. The feedstock can be further characterized with approx. 0.1% of its components evolving below 193° C. (naphtha/kerosene fraction), v. approx. 1.3 to 4.8% for the liquid product. The kerosene and diesel fractions also demonstrates significant differences between the feedstock and liquid product with 1% of the feedstock fraction evolving between 193-232° C. v. 2.8 to 5% for the liquid product, and with 8.7% (feedstock) and 18.9 to 23.1% (liquid product) evolving at this temperature range (232-327° C.; diesel). Collectively these results show that a substantial proportion of the components with low volatility in the feedstock have been converted to components of higher volatility (light naphtha, kerosene and diesel) in the liquid product. These results demonstrate that the liquid product is substantially upgraded, and exhibits properties suitable for transport.

TABLE 14

Properties and SimDist of liquid products prepared from Bitumen following "Two Stage" processing (reactor temp. 538° C.; for feedstock properties see Tables 1, 8 and 9).

| Fraction | Temp (° C.) | R243 |
|---|---|---|
| Density @ 15.6° C. | — | 0.9737 |
| API | — | 13.7 |
| Viscosity @ 40° C. | — | 45.4 |
| Light Naphtha | <71 | 0.3 |
| Light/med Naphtha | 71-100 | 0.4 |
| Med Naphtha | 100-166 | 3.6 |
| Naphtha/Kerosene | 166-193 | 1.9 |
| Kerosene | 193-232 | 4.4 |
| Diesel | 232-327 | 19.7 |
| Light VGO | 327-360 | 9.1 |
| Heavy VGO | 360-538 | 41.1 |
| Vacuum Resid. | >538 | 19.5 |

Under these run conditions the API increased from 8.6 to about 14. A product yield of 68.4 (wt %) was obtained along with greatly reduced viscosity levels (from 30380 cSt @40° C. in the feedstock, to approx. 45 cSt in the liquid product).

Simulated distillation analysis demonstrates that over 50% of the components within the feedstock evolve at temperatures above 538° C. (vacuum resid fraction) while 80.5% of the liquid product evolves below 538° C. The feedstock can be further characterized with approx. 0.1% of its components evolving below 193° C. (naphtha/kerosene fraction), v. 6.2% for the liquid product. The diesel fraction also demonstrates significant differences between the feedstock and liquid product with 8.7% (feedstock) and 19.7% (liquid product) evolving at this temperature range (232-327° C.). Collectively these results show that a substantial proportion of the components with low volatility in the feedstock have been converted to components of higher volatility (light naphtha, kerosene and diesel) in the liquid product. These results demonstrate that the liquid product is substantially upgraded, and exhibits properties suitable for transport.

EXAMPLE 6

Further Characterization of Vacuum Gas Oil (VGO)

Vacuum Gas Oil (VGO) was obtained from a range of heavy petroleum feedstocks, including:

- Athabasca bitumen (ATB; ATB-VGO(243) and ATB-VGO (255))
- a hydrotreated VGO from Athabasca bitumen (Hydro-ATB);
- an Athabasca VGO resid blend (ATB-VGO resid);
- a hydrotreated ATB-VGO resid (Hydro-ATB-VGO resid; obtained from the same run as ATB-255); and
- a Kerrobert heavy crude (KHC).

The liquid product following thermal processing of the above feedstocks was distilled to produce a VGO fraction using standard procedures disclosed in ASTM D2892 and ASTM D5236.

For hydrotreating the Athabsaca bitumen VGO, the reactor conditions were as follows:

reactor temperature 720° F.;

reactor pressure 1,500 psig;

Space Velocity 0.5;

Hydrogen rate 3625 SCFB.

Alaskan North Slope crude oil (ANS) was used for reference.

Properties of these VGOs are presented in Table 15.

TABLE 15

Properties of VGOs obtained from a variety of heavy oil feedstocks

| | ATB-VGO (243) | ATB-VGO (255) | ATB-VGO resid | KHC-VGO | ANS-VGO | Hydro-ATB-VGO |
|---|---|---|---|---|---|---|
| API Gravity | 13.8 | 15.2 | 11.8** | 15.5 | 21.7 | 22.4 |
| Sulfur, wt % | 3.93 | 3.76 | 4.11** | 3.06 | 1.1 | 0.27 |
| Aniline Point, EF* | 110 | 125 | 148-150 | 119 | 168 | 133.4 |

*for calculated aniline point see Table 17

**estimated

Cracking characteristics of each of the VGOs were determined using Microactivity testing (MAT) under the following conditions (also see Table 16):

reaction temperature 1000° F.;

Run Time 30 seconds;

Cat-to-oil-Ratio 4.5;

Catalyst Equilibrium FCC Catalyst.

The results from MAT testing are provided in Table 16, and indicate that cracking conversion for ATB-VGO (243), is approximately 63%, for KHC-VGO is about 6%, for ANS-VGO it is about 73%, and for Hydro-ATB-VGO is about 74%. Furthermore, cracking conversion for Hydro-ATB-VGO resid (obtained from ATB-255) is about 3% on volume higher than the VGO from the same run (i.e. ATB-VGO (255)). The modeling for the ATB-VGO and hydro-ATB-VGO incorporate a catalyst cooling device to maintain the regenerator temperature within its operating limits.

TABLE 16

Microcativity Testing (MAT) results

| | ATB-VGO-243 | ATB-VGO-255 | KHC-VGO | ANS-VGO | Hydro-ATB-VGO 243 | ATB-VGO resid |
|---|---|---|---|---|---|---|
| Catalyst Charge (grams) | 4.5054 | 4.5137 | 4.5061 | 4.5064 | 4.5056 | 4.5238 |
| Feed Charge (grams) | 1.0694 | 1.055 | 1.0553 | 1.0188 | 1 | 1.0753 |
| Catalyst/Oil Ratio | 4.2 | 4.3 | 4.3 | 4.4 | 4.5 | 4.2 |
| Preheat Temperature (EF) | 1015 | 1015 | 1015 | 1015 | 1015 | 1015 |
| Bed Temperature (EF) | 1000 | 1000 | 1000 | 1000 | 1000 | 1000 |
| Oil Inject Time (sec) | 30 | 30 | 30 | 30 | 30 | 30 |
| Conversion (Wt %) | 62.75% | 65.69% | 65.92% | 73.02% | 74.08% | 65.24% |
| Normalized (Wt %) | 2.22% | 2.28% | 1.90% | 0.79% | 0.13% | 2.43% |
| $H_2S$ | | | | | | |
| $H_2$ | 0.19% | 0.16% | 0.18% | 0.17% | 0.24% | 0.16% |
| $CH_4$ | 1.44% | 1.24% | 1.33% | 1.12% | 1.07% | 1.34% |
| $C_2H_2$ | 0.00% | 0.00% | 0.00% | 0.00% | 0.00% | 0.00% |
| $C_2H_4$ | 1.01% | 0.94% | 1.05% | 0.97% | 0.93% | 0.91% |
| $C_2H_6$ | 1.03% | 0.86% | 0.94% | 0.76% | 0.66% | 0.94% |
| $C_3H_4$ | 0.00% | 0.00% | 0.00% | 0.00% | 0.00% | 0.00% |
| $C_3H_6$ | 4.11% | 3.99% | 4.39% | 5.15% | 4.55% | 3.73% |
| $C_3H_6$ | 1.01% | 1.01% | 1.06% | 1.16% | 1.01% | 1.00% |
| $C_4H_6$ | 0.00% | 0.00% | 0.00% | 0.00% | 0.00% | 0.00% |
| 1-$C_4H_8$ | 0.90% | 1.71% | 1.02% | 1.19% | 1.09% | 0.81% |
| 1-$C_4H_8$ | 0.96% | 0.69% | 0.92% | 1.05% | 0.83% | 0.79% |
| c-2-$C_4H_8$ | 0.69% | 0.69% | 0.81% | 0.97% | 0.80% | 0.65% |
| t-2-$C_4H_8$ | 0.98% | 0.43% | 1.13% | 1.36% | 1.14% | 0.91% |
| 1-$C_4H_{10}$ | 2.58% | 2.65% | 3.20% | 4.31% | 4.59% | 2.44% |
| N-$C_4H_{10}$ | 0.38% | 0.48% | 0.50% | 0.65% | 0.63% | 0.48% |
| C5-430° F. | 39.53% | 43.54% | 42.35% | 49.10% | 52.67% | 41.97% |
| 430° F.-650° F. | 23.29% | 22.50% | 22.30% | 18.75% | 18.92% | 22.60% |
| 650° F.-800° F. | 10.71% | 8.86% | 9.03% | 6.06% | 5.27% | 8.85% |

TABLE 16-continued

| Microcativity Testing (MAT) results | | | | | | |
|---|---|---|---|---|---|---|
| | ATB-VGO-243 | ATB-VGO-255 | KHC-VGO | ANS-VGO | Hydro-ATB-VGO 243 | ATB-VGO resid |
| 800° F. | 3.24% | 2.94% | 2.75% | 2.17% | 1.74% | 3.31% |
| Coke | 5.73% | 5.04% | 5.13% | 4.28% | 3.73% | 6.69% |
| Material Balance | 97.93% | 98.04% | 98.03% | 96.59% | 97.10% | 98.16% |

Aniline points were determined using ASTM Method D611. The results, as well as conversion and yield on the basis of vol % are presented in Table 17A and B. Similar results were obtained when compared on a wt % basis (data not shown). Cracking conversion for ATB-VGO (243) and KHC-VGO is 21% and 16% on volume lower that for ANS VGO. Hydrotreated ATB is 5% on volume lower that ANS-VGO.

The difference in the conversion for ATB-VGO, KHC-VGO and Hydro-ATB-VGO relative to ANS-VGO (control) listed in Table 17A is larger than expected, when the results of the MAT test (Table 16) are considered. This true for ATB-VGO (243), (255), KHC-VGO, Hydro-ATB-VGO, ATB-VGO-resid, and Hydro ATB-VGO-resid. To determine if the measured aniline point is not a reliable indicator of the ATB-,

TABLE 17A

| Measured Aniline Point on a vol % basis | | | | | |
|---|---|---|---|---|---|
| | ANS-VGO Vol % FF | ATB-VGO(243) Vol % FF | Hydro-ATB-VGO Vol % FF | KHC-VGO Vol % FF | ATB-VGO(255) Vol % FF |
| Fresh Feed Rate: MBPD | 68.6 | 68.6 | 68.6 | 68.6 | 68.6 |
| Riser Outlet Temperature ° F. | 971 | 971 | 971 | 971 | 971 |
| Fresh Feed Temperature ° F. | 503 | 503 | 503 | 503 | 503 |
| Regenerator Temperature ° F. | 1334 | 1609 | 1375 | 1562 | 1511 |
| Conversion | 73.85 | 53.01 | 68.48 | 57.58 | 56.53 |
| $C_2$ and Lighter, Wt % FF | 4.13 | 8.19 | 4.53 | 7.70 | 7.37 |
| $H_2S$ | 0.54 | 1.37 | 0.12 | 1.18 | 1.35 |
| $H_2$ | 0.18 | 0.21 | 0.22 | 0.25 | 0.20 |
| Methane | 1.35 | 2.87 | 1.65 | 2.65 | 2.45 |
| Ethylene | 1.00 | 1.37 | 1.31 | 1.51 | 1.31 |
| Ethane | 1.07 | 2.36 | 1.23 | 2.11 | 2.06 |
| Total $C_3$ | 9.41 | 7.15 | 10.01 | 8.18 | 7.50 |
| Propylene | 7.37 | 5.79 | 7.81 | 6.54 | 6.06 |
| Propane | 2.04 | 1.35 | 2.20 | 1.64 | 1.44 |
| Total $C_4$ | 13.79 | 9.35 | 13.05 | 11.57 | 10.34 |
| Isobutane | 4.25 | 2.40 | 4.85 | 3.21 | 2.65 |
| N-Butane | 1.08 | 0.35 | 1.07 | 0.53 | 0.39 |
| Total Butenes | 8.46 | 6.60 | 7.13 | 7.83 | 7.30 |
| Gasoline ($C_5$-430° F. | 58.46 | 35.35 | 51.56 | 39.43 | 38.58 |
| LCGO (430-650° F.) | 20.78 | 34.74 | 27.08 | 32.06 | 32.05 |
| HCGO + DO (650° F.) | 5.37 | 12.25 | 4.44 | 10.36 | 11.42 |
| Coke, Wt % | 5.50 | 5.835.50 | 5.53 | 5.82 | 5.70 |
| API Gravity | 21.7 | 13.9 | 22.4 | 15.5 | 15.2 |
| Aniline Point: ° F. (Measured) | 168 | 110 | 133.4 | 119.0 | 125 |

KHC- and Hydro-VGOs, the aniline point was calculated using standard methods known in the art based, upon distillation data and API gravity. The calculated aniline points, and cracking conversion for the various VGO's are presented in Tables 17B and C.

TABLE 17B

| Calculated Aniline Point on a vol % basis | ANS-VGO) Vol % FF | ATB-VGO(243) Vol % FF | Hydro-ATB-VGO Vol % FF | KHC-VGO Vol % FF |
|---|---|---|---|---|
| Fresh Feed Rate: MBPD | 68.6 | 68.6 | 68.6 | 68.6 |
| Riser Outlet Temperature ° F. | 971 | 971 | 971 | 971 |
| Fresh Feed Temperature ° F. | 503 | 503 | 503 | 503 |
| Regenerator Temperature ° F. | 1334 | 1464 | 1272 | 1383 |
| Conversion | 73.85 | 57.45 | 74.25 | 62.98 |
| $C_2$ and Lighter, Wt % FF | 4.13 | 6.79 | 3.53 | 6.05 |
| $H_2S$ | 0.54 | 1.40 | 0.13 | 1.25 |
| $H_2$ | 0.18 | 0.17 | 0.18 | 0.16 |
| Methane | 1.35 | 2.14 | 1.21 | 1.86 |
| Ethylene | 1.00 | 1.19 | 1.07 | 1.20 |
| Ethane | 1.07 | 1.89 | 0.94 | 1.57 |
| Total $C_3$ | 9.41 | 7.33 | 10.10 | 8.27 |
| Propylene | 7.37 | 5.93 | 8.10 | 6.59 |
| Propane | 2.04 | 1.40 | 2.00 | 1.68 |
| Total $C_4$ | 13.79 | 10.76 | 15.26 | 12.18 |
| Isobutane | 4.25 | 2.75 | 5.01 | 3.37 |
| N-Butane | 1.08 | 0.41 | 1.18 | 0.54 |
| Total Butenes | 8.46 | 7.60 | 9.07 | 8.27 |
| Gasoline ($C_5$-430 EF) | 58.46 | 39.71 | 57.07 | 45.57 |
| LCGO (430-650 EF) | 20.78 | 30.85 | 22.20 | 27.70 |
| HCGO + DO (650 EF+) | 5.37 | 11.70 | 3.55 | 9.32 |
| Coke, Wt % FF | 5.50 | 5.56 | 5.33 | 5.46 |
| API Gravity (Feed) | 21.7 | 13.8 | 22.4 | 15.5 |
| Aniline Point: ° F. (Calc) | 168 | 135.0 | 158.0 | 144.0 |

TABLE 17C

| Calculated Aniline Point on a vol % basis, continued | ATB-VGO (255) Vol % FF | Hydro-ATB-VGO (255) Vol % FF | ATB-VGO resid Vol % FF | Hydro ATB-VGO resid Vol % FF |
|---|---|---|---|---|
| Fresh Feed Rate: | 68.6 | 68.6 | 68.6 | 68.6 |
| Riser Outlet Temperature ° F. | 971 | 971 | 971 | 971 |
| Fresh Feed Temperature ° F. | 503 | 503 | 503 | 503 |
| Regenerator Temperature ° F. | 1374 | 1238 | 1345* | 1345* |
| Conversion | 60.86 | 75.29 | 83.82 | 72.34 |
| $C_2$ and Lighter | 6.13 | 3.36 | 4.80 | 4.13 |
| $H_2S$ | 1.42 | 0.12 | 1.55 | 0.04 |
| $H_2$ | 0.14 | 0.17 | 0.18 | 0.60 |
| Methane | 1.85 | 1.13 | 1.43 | 1.56 |
| Ethylene | 1.10 | 1.04 | 0.48 | 0.79 |
| Ethane | 1.63 | 0.89 | 1.17 | 1.14 |
| Total $C_3$ | 7.54 | 10.44 | 7.66 | 8.49 |
| Propylene | 6.07 | 8.62 | 5.97 | 6.76 |
| Propane | 1.47 | 1.82 | 1.69 | 1.73 |
| Total $C_4$ | 11.58 | 16.56 | 12.99 | 12.60 |
| Isobutane | 2.96 | 4.96 | 3.34 | 3.75 |
| N-Butane | 0.44 | 1.19 | 0.49 | 0.99 |
| Total Butenes | 8.18 | 10.40 | 9.16 | 7.85 |

TABLE 17C-continued

| Calculated Aniline Point on a vol % basis, continued | ATB-VGO (255) Vol % FF | Hydro-ATB-VGO (255) Vol % FF | ATB-VGO resid Vol % FF | Hydro ATB-VGO resid Vol % FF |
|---|---|---|---|---|
| Gasoline ($C_5$-430° F.) | 43.38 | 56.87 | 45.61 | 56.66 |
| LCGO (430-650° F.) | 28.61 | 21.09 | 26.28 | 21.59 |
| HCGO + DO (650° F.) | 10.52 | 3.62 | 9.89 | 6.06 |
| Coke, Wt % FF | 5.43 | 5.30 | 7.54 | 6.42 |
| API Gravity (Feed) | 15.2 | 23.9 | 11.8 | 20.0 |
| Aniline Point EF (Cacl) | 145 | 168 | 148.0 | 170.0 |

Based upon the calculated aniline points, the aniline point all increased and are more in keeping with the data determined from MAT testing. For example, the aniline point of:

ATB-VGO (243) is 135° F.,

ATB-VGO (255) is 145° F.,

KHC-VGO is 144° F.,

ATB-VGO-resid is 148° F.,

Hydro-ATB-VGO is 158° F., and

Hydro-ATB-VGO-resid is 170° F.

There is no change in the aniline point or product yield for the ANS-VGO (control). Along with the increased calculated aniline points were increased product yields are consistent with the cracking differences MAT results of Table 16.

These results indicate that RTP product VGOs have a plurality of side chains available for cracking, and provide higher levels of conversion than those derived from the aniline point measurements.

EXAMPLE 7

Effect of Calcium Addition on Properties of Liquid Product Derived from Rapid Thermal Processing of Heavy Hydrocarbon Feedstocks A: Effect of Calcium Addition on Properties of Liquid Product Derived from the Processing of a Bitumen, Including TAN (Total Acid Number)

Baseline testing was performed during normal operation rapid thermal processing (Period 1, Table 18, below). A second test involved adding $Ca(OH)_2$ (8.4 wt %) to the sand reheater (Period 2, Table 18), and a third test was conducted while $Ca(OH)_2$ (4 wt %) was mixed with a Bitumen feedstock (Period 3, Table 18). Addition of $Ca(OH)_2$ to the sand reheater was made within the line returning sand and coke to the sand reheater from separator 180. Addition of $Ca(OH)_2$ to the feedstock was made using the feedstock line (270). Rapid thermal processing of the feedstock was carried out at a temperature of from 510 to 540° C. The temperature of the sand reheater ranged from 730-815° C. API gravity and specific gravity, were determined using ASTM method D4052; viscosity was determined using ASTM D445; Ash was determined using D482-95; MCRT (microcarbon residue test) was assayed using ASTM D4530-95; TAN (total acid number) was assayed using D664; sulfur was measured using D4294; Metals (Ni, V, Ca and Mg) were determined using D5708. The composition of the feedstock (Feed) and of the liquid product (Prod) arising from each of these treatments is shown in Table 18.

TABLE 18A

Composition of a bitumen feedstock (Feed), and liquid products (Prod) following rapid thermal pyrolysis in the presence and absence of $Ca(OH)_2$ (see below for definitions of Period 1-3)

| RUN 278 | PERIOD 1 Feed | PERIOD 3 Feed | PERIOD 1 Prod | PERIOD 2 Prod | PERIOD 3 Prod |
|---|---|---|---|---|---|
| API Gravity (deg API) | 7.9 | 5.4 | 14.0 | 12.8 | 13.6 |
| Specific gravity | 0.9992 | 1.0184 | 0.9727 | 0.9803 | 0.9755 |
| Viscosity @ 20° C. (cSt) | n/a | n/a | 626 | 633 | 663 |
| Ash @ 550° C. (wt %) | 0.07 | 5.17 | 0.14 | 1.24 | 0.20 |
| MCRT (wt %) | 13.2 | 15.1 | 6.7 | 7.0 | 6.2 |
| Neutralization number, TAN (total acid number; mg KOH/g) | 3.37 | 1.06 | 2.49 | 2.01 | 0.55 |
| Sulfur (wt %) | 4.1 | 1.9 | 4.2 | 3.1 | 4.0 |
| Metals Ni, ppm | 66 | 67 | 21 | 20 | 20 |
| Metals V, ppm | 176 | 182 | 63 | 74 | 59 |
| Metals Ca, ppm | 4.8 | 18650 | 52 | 3877 | 476 |
| Metals Mg, ppm | 0.2 | 138 | 4 | 31 | 4 |

Period 1: regular thermal processing (no calcium compound addition)
Period 2: addition of $Ca(OH)_2$ to sand reheater
Period 3: addition of $Ca(OH)_2$ to feedstock These results indicate that addition of $Ca(OH)_2$ to the sand reheater or to the feedstock does not alter the API gravity or specific gravity of the liquid product in any significant manner. The TAN value of the liquid product was reduced when the feedstock was processed in the presence of $Ca(OH)_2$. The reduction of the TAN value was greatest, however, when $Ca(OH)_2$ was added to the feedstock (Period 3) than when it is added to the sand reheater (period 2). Specifically, the TAN value in the product was lowered from 2.49 to 2.01 when $Ca(OH)_2$ was added to the sand reheater during processing of the feedstock, however, addition of $Ca(OH)_2$ to the feedstock lowered the TAN value of the product significantly to 0.55.

The liquid product produced in the presence of $Ca(OH)_2$ exhibits an increased concentration of $Ca(OH)_2$. This is observed in liquid products produced with $Ca(OH)_2$ added to the feedstock or sand reheater, indicating that part of the $Ca(OH)_2$ is recycled with the particulate heat carrier from the sand reheater.

Separate studies (data not presented) indicated that addition of CaO (3 wt %) in the presence of water (1 to 3 wt %) to bitumen, or the addition of $Ca(OH)_2$ (from 1-16 wt %), to bitumen, resulted in a reduction of the acid content of the bitumen from a TAN of 3.22 (mg KOH/g), to less than 0.05 (mg KOH/g).

B: Effect of Calcium Addition on TAN Values of Liquid Product Derived from the Processing of a Heavy Oil Feedstock having a High TAN Value and Low Sulfur Concentration This test involved adding a total of 1.2 wt. % Ca, in the form of $Ca(OH)_2$, to a heavy oil feedstock, San Ardo field (Bakersfield, Calif.). Addition of $Ca(OH)_2$ to the feedstock was made using the feedstock line (270). Rapid thermal processing of the feedstock was carried out at a temperature of from 70 to 100° C. The temperature of the sand reheater ranged from 730-815° C. The feedstock was introduced into the reactor at a rate of 50 lbs./hr. TAN (total acid number) was assayed using ASTM method D664. The TAN values of the untreated feedstock, the feedstock treated with a total of 3.0 wt. % $Ca(OH)_2$ and the liquid products derived from rapid thermal processing of the calcium-treated feedstock are shown in Table 19.

TABLE 19

TAN values of heavy oil feedstock, and liquid products following rapid thermal pyrolysis in the presence of $Ca(OH)_2$

| RUN 286 | Ca, wt % | TAN, mg KOH/g |
|---|---|---|
| Untreated Feedstock | 0.00605 | 5.03 |
| Feedstock treated with 3.0 wt. % $Ca(OH)_2$ (Calcium-treated feedstock) | 1.21 | 1.65 |
| Product derived from calcium-treated feedstock[a] | 0.00316 | 0.87 |
| Product derived from calcium-treated feedstock[b] | 0.00565 | 1.01 |
| Product derived from calcium-treated feedstock[c] | 0.0039 | 0.99 |

[a]product taken from first condenser
[b]product taken from second condenser
[c]product taken from demister The products produced by this experiment exhibited TAN values that were about 5 times less than the TAN of the untreated feedstock. There was no significant difference in the TAN values of the products derived from the first condenser, the second condenser or from the demister. The TAN value of the feedstock at the end of experiment (1.65) was three times lower than the TAN value of the untreated feedstock (5.03). This reduction in the TAN value of the feedstock can extend the lifetime of the fast pyrolysis reactor, due to less corrosion, as well as that of other components used within the processing system. The wt % of Ca in each of liquid products was less than the amount of calcium present in the feedstock before the addition of $Ca(OH)_2$ demonstrating that the calcium compound added to the feedstock does not carry through with the product to the condensers or the demister.

EXAMPLE 8

Effect of Calcium Addition on the Concentration of $SO_2$ Emitted in Flue Gas during Fast Pyrolysis of Heavy Hydrocarbon Feedstocks A: Effect of Calcium Addition on the Concentration of $SO_2$ Emitted in Flue Gas During Fast Pyrolysis of a Bitumen Feddstock An emission testing program was conducted to assess the benefits of adding calcium, for example, but not limited to, calcium hydroxide ($Ca(OH)_2$) to the sand reheater (30, fluid bed reheater) or the feed of the rapid thermal processing system while processing a bitumen feedstock. Additions to the sand reheater were made within the line returning sand and coke to the sand reheater from separator 180. Additions to the feedstock were made using the feedstock line (270).

Testing was conducted to quantify the sulphur dioxide ($SO_2$, or any gaseous sulfur species) reduction potential associated with $Ca(OH)_2$ addition to either the feedstock or the sand reheater. Emission testing was also conducted for particulate matter and combustion gases. Results of this time course analysis are presented in FIGS. 6 and 7. FIG. 6 shows a time course following several calcium additions to the sand reheater and feedstock lines, while FIG. 8 shows a time course of a calcium addition to the sand reheater.

With reference to FIGS. 7 and 8, there is shown the sampling of $SO_2$ ($SO_x$) emissions in flue gas produced over time during rapid thermal processing of a bitumen feedstock essentially as described in Example 1, with a reaction temperature of from 510 to 540° C. The temperature of the sand reheater ranged from 730-815° C. The residence time at each temperature was 1-2 sec. The average reactor temperature record is shown in the upper panel of FIG. 7.

Sulfur was analyzed using a SICK AG GME64 infrared gas analyzer. Base line readings of $SO_2$ in the absence of any added $Ca(OH)_2$ fluctuated at about 1000 to about 1400.

The reheater loading was mostly using 8.4 wt % $Ca(OH)_2$ per feed. Since the feed sulphur content was about 5 wt %, the stoichiometric ratio of Ca/S per feed was about 0.7. However, since only about 35-45 wt. % of the original sulphur ends up in the reheater, the reheater stoichiometric ratio of Ca/S was 1.7-2. When 4 wt % $Ca(OH)_2$ was added to feed, the stoichiometric ratio of Ca/S per feed was about 0.3, and was about 1 in the reheater. The following represents the timeline of the experiment (see FIG. 7):

13:00 (A)—addition of 8.4 wt % (of the feed—approx 1.7-2 fold stoichiometric amount) $Ca(OH)_2$ to the sand reheater resulted in rapid and a dramatic reduction of flue gas $SO_2$ emissions from about 1400 to about 400 in about 5 min, and decreased over the next hour to a level of about 200 (this portion of FIG. 7 is presented in FIG. 8);

14:18 (B)—$Ca(OH)_2$ addition was stopped resulting in a steady increase in $SO_2$ emission back to near base line levels of about 1150. This lower base line may be due to $Ca(OH)_2$ recycling along with the particulate heat carrier within the system;

16:15 (C)—after a stable base line was obtained, $Ca(OH)_2$ (8.4 wt % ) was added to the sand reheater, and a second rapid reduction in $SO_2$ emission was observed;

16:50 (D)—addition of $Ca(OH)_2$ was stopped with an associated increase in sulfur emission;

17:13 (E)—a lower amount of $Ca(OH)_2$ (6.6 wt %) was added to the sand reheater, and $SO_2$ emissions were reduced again;

17:36 (F)—$Ca(OH)_2$ addition was stopped. Again the lower base line (at 17:59 v. that at 12:00, or 15:00) may be due to $Ca(OH)_2$ recycling within the system;

18:00 (G)—1 wt % (per feed) $Ca(OH)_2$ was added to the feedstock, and a slight decrease in $SO_2$ emissions was noted;

18:37 (H)—2 wt % (per feed) $Ca(OH)_2$ is added to the feedstock and a second, more rapid decrease in $SO_2$ emissions was evident;

19:12 (I)—4 wt % (per feed) $Ca(OH)_2$ is added to the feedstock, with yet a more rapid decrease in $SO_2$ emissions was observed;

20:29 (J)—$Ca(OH)_2$ addition was stopped.

Based on the data, removal efficiency of sulfur from the flue gass, attributed to the $Ca(OH)_2$ injection into the fluidized bed of the sand reheater, can reach 95%.

Additions of $Ca(OH)_2$ to the feedstock also caused a gradual decrease in flue gas $SO_2$. Sub-stoichiometric amounts of $Ca(OH)_2$ caused marginal (less than proportional) $SO_2$ reductions. About stoichiometric amounts are clearly more effective. A 90% reduction in sulfur emissions would be expected when add-mixing just over the stoichiometric amount to the feed.

B: Effect of Calcium Addition on the Concentration of $SO_2$ Emitted in Flue Gas during Fast Pyrolysis of a High TAN Low Sulfur-Containing Heavy Oil Feddstock An emission testing program was conducted to assess the benefits of adding calcium, for example, but not limited to, calcium hydroxide ($Ca(OH)_2$) to the feed of the rapid thermal processing system while processing a heavy oil feedstock, San Ardo field (Bakersfield, Calif. Additions to the feedstock were made using the feedstock line (270).

Testing was conducted to quantify the sulphur dioxide ($SO_2$, or any gaseous sulfur species) reduction potential associated with $Ca(OH)_2$ addition to the feedstock. Emission testing was also conducted for particulate matter and combustion gases. FIG. 9 shows a time course following several calcium additions to the feedstock line.

With reference to FIG. 8, there is shown the sampling of $SO_2$ emissions in flue gas produced over time during rapid thermal processing of a heavy oil feedstock, San Ardo field (Bakersfield, Calif.), with a reaction temperature of from 70 to 100° C. The temperature of the sand reheater ranged from 730-815° C. The residence time at each temperature was 1-2 sec.

Sulfur was analyzed using a SICK AG GME64 infrared gas analyzer. Base line readings of $SO_2$ in the absence of any added $Ca(OH)_2$ fluctuated at about 1000 to about 1400.

The following represents the timeline of the experiment (see FIG. 8):

15:20 (A)—addition of 1.5 wt % (of the feed) $Ca(OH)_2$, in the presence of 5% water, to the feedstock, resulted in a reduction of flue gas $SO_2$ emissions from about 500 to about 250 in about 30 min, and decreased over the next 1.8 hours to a level of about 200;

17:37 (B)—a second addition of 1.5 wt % (of the feed) $Ca(OH)_2$ was added to the feedstock resulting in a further decrease in flue gas $SO_2$ emissions to about 160 ppm over the next 0.65 hour.

EXAMPLE 9

Effect of Calcium Addition on the Amount of $H_2S$ Produced during Fast Pyrolysis of a High TAN, Low Sulfur-Containing Heavy Oil Feedstock Rapid thermal processing of a feedstock oil can produce hydrogen sulfide ($H_2S$) as a by-product, which contaminates the components of the product stream. The concentration of $H_2S$ depends on the concentration and type of sulfur compounds present in the feedstock. This example demonstrates that rapid thermal processing of the feedstock oil in the presence of a calcium compound can reduce the amount of hydrogen sulfide ($H_2S$) contaminating gas components of the product stream.

A heavy oil feedstock containing 2.2 wt % sulfur (San Ardo field; Bakersfield, Calif.) was subjected to rapid thermal processing in the absence and presence of $Ca(OH)_2$. The product gas produced from pyrolysis of the feedstock in the absence of $Ca(OH)_2$ contained approximately 1 vol % $H_2S$ (see sample 1, Table 20). The addition of 0.6 wt % of calcium in the form of $Ca(OH)_2$ reduced the $H_2S$ concentration in the product to about 0.4 vol %, about a 60% decrease in hydrogen sulfide content (see samples 2-3, Table 20). Further addition of $Ca(OH)_2$ to the feed (1.2 wt % total) lowered the $H_2S$ content to below the GC detection limit (sample 4, Table 20). The effectiveness of $Ca(OH)_2$ to reduce the hydrogen sulfide content was affected by the feed/sand ratio (sample 5, Table 20).

TABLE 20

$H_2S$ content of gas products produced from rapid thermal pyrolysis of a heavy hydrocarbon feedstock, in the absence and presence of $Ca(OH)_2$

| Product gas collection samples | 1 | 2 | 3 | 4 | 5 |
|---|---|---|---|---|---|
| Calcium addition, wt % Ca in feed | — | 0.6 | 0.6 | 1.2 | 1.2 |
| Feed rate, lb/hr | 50 | 50 | 50 | 50 | 100+ |
| $H_2S$ ($N_2$, $O_2$ free), vol % | 0.97 | 0.46 | 0.39 | 0.00 | 0.37 |
| Percentage of $H_2S$ removed by Ca treatment | — | 53 | 60 | 100 | 62 |

All citations are herein incorporated by reference.

The present invention has been described with regard to preferred embodiments. However, it will be obvious to persons skilled in the art that a number of variations and modifications can be made without departing from the scope of the invention as described herein.

The invention claimed is:

1. A method of reducing the hydrogen sulfide content of a product stream from upgrading a heavy hydrocarbon feedstock and reducing sulfur-based gas emissions in flue gas during said upgrading, comprising:

(i) treating the heavy hydrocarbon feedstock with a first portion of calcium compound, (ii) introducing said treated feedstock to an upflow reactor, (iii) rapid thermal processing of the treated feedstock, wherein the rapid thermal processing comprises allowing the treated feedstock to interact with a particulate heat carrier in the upflow reactor run at a temperature in the reactor from 450 to 600° C. for less than 5 seconds, to produce a product stream, and wherein the ratio of the particulate heat carrier to the heavy hydrocarbon feedstock is from 10:1 to 200:1, and (iv) regenerating the particulate heat carrier in a reheater to form a regenerated particulate heat carrier, and (v) recycling the regenerated particulate heat carrier to the upflow reactor, wherein:

(a) a second portion of calcium compound is added to the reheater, (b) the particulate heat carrier is different from the first and second portions of calcium compound, and (c) the amount of the first and second portions of calcium compound added is from about 0.2 to about 5 fold the stoichiometric amount of sulfur in the feedstock.

2. The method of claim 1, further comprising a step of removing a mixture comprising the product stream and the particulate heat carrier from the reactor.

3. The method of claim 2, further comprising a step of separating the product stream and the particulate heat carrier from said mixture.

4. The method of claim 3, further comprising a step of collecting a distillate product and a bottoms product from the product stream.

5. The method of claim 4, wherein the bottoms product is subjected to a further step of rapid thermal processing.

6. The method of claim 5, wherein the further step of rapid thermal processing comprises allowing the bottoms product to interact with a particulate heat carrier in the reactor for less than about 5 seconds, wherein the ratio of the particulate heat carrier to the heavy hydrocarbon feedstock is from about 10:1 to about 200:1 to produce a product stream.

7. The method of claim 1, wherein the reheater is run at a temperature in the range from about 600° C. to about 900° C.

8. The method of claim 1, wherein the reheater is run at a temperature in the range from about 600° C. to about 815° C.

9. The method of claim 1, wherein the reheater is run at a temperature in the range from about 700° C. to about 800° C.

10. The method of claim 1, wherein the reactor is run at a temperature in the range from about 480° C. to about 550° C.

11. The method of claim 1, wherein the amount of the first and second portions of calcium compound that is added is from about 1.7 to about 2 fold the stoichiometric amount of sulfur in the heavy hydrocarbon feedstock.

12. The method of claim 1, wherein the first and second portions of calcium compound are selected from the group consisting of calcium acetate, calcium formate, calcium proprionate, a calcium salt-containing bio-oil composition, a calcium salt isolated from a calcium salt-containing bio-oil composition, $Ca(OH)_2$, CaO, $CaCO_3$, and a mixture thereof.

13. The method of claim 1, wherein the first portion of calcium compound is combined with the heavy hydrocarbon feedstock and 0-5 weight % water, relative to the weight of the heavy hydrocarbon feedstock.

14. The method of claim 13, wherein the water is in the form of steam.

15. The method of claim 1, wherein total acid number (TAN) in the liquid product is reduced.

16. The method of claim 1, wherein prior to the step of rapid thermal processing, the feedstock is introduced into a fractionation column that separates a volatile component of the feedstock from a liquid component of the feedstock, and the liquid component is subjected to rapid thermal processing.

17. The method of claim 16, wherein the feedstock is combined with the first portion of calcium compound before being introduced into the fractionation column.

18. The method of claim 1, wherein the first and second portions of calcium compound are selected from the group consisting of $Ca(OH)_2$, CaO, and a mixture thereof.

19. The method of claim 1, wherein the first and second portions of calcium compound are $Ca(OH)_2$.

20. The method of claim 1, wherein the heavy hydrocarbon feedstock is:

1) a high TAN value, low sulfur content heavy hydrocarbon feedstock;

2) a low TAN value, high sulfur content heavy hydrocarbon feedstock; or 3) a high TAN value, high sulfur content heavy hydrocarbon feedstock.

21. The method of claim 1, wherein the TAN value of the treated heavy hydrocarbon feedstock is at least three fold lower when compared to an identical heavy hydrocarbon feedstock untreated by a calcium containing compound.

22. The method of claim 1, wherein the TAN value of the treated heavy hydrocarbon feedstock is no greater than 1.65 (mg KOH/g).

23. The method of claim 1, wherein the TAN value of the treated heavy hydrocarbon feedstock is less than 0.55 (mg KOH/g).

24. The method of claim 1, wherein the first and second portions of calcium compound are selected from $Ca(OH)_2$, CaO, and $CaCO_3$.

25. The method of clam 1, wherein the first and second portions of calcium compound are selected from CaO and $CaCO_3$.

26. The method of claim 1, wherein the first and second portions of calcium compound are a fine powder.

27. The method of claim 1, wherein the particulate heat carrier is sand.

28. The method of claim 1, wherein the size of the particulate heat carrier is greater than the size of the first and second portions of calcium compound.

29. The method of claim 1, wherein the amount of the first and second portions of calcium compound required to lower the level of sulfur-based gas emissions is reduced.

30. The method of claim 1, wherein up to 5 wt. % water, relative to the weight of the heavy hydrocarbon feedstock, is present.

31. The method of claim 1, wherein up to 5 wt. % water, relative to the weight of the heavy hydrocarbon feedstock, is added together with the calcium compound.

32. The method of claim 1, wherein the reduction of the sulfur-based gas emissions is at least 85% lower than that produced by an identical method in the absence of a calcium containing compound.

33. The method of claim 1, wherein the reduction of the sulfur-based gas emissions is at least 90% lower than that produced by an identical method in the absence of a calcium containing compound.

34. The method of claim 1, wherein the reduction of the sulfur-based gas emissions is at least 95% lower than that produced by an identical method in the absence of a calcium containing compound.

35. The method of claim 1, wherein the TAN value of the liquid product produced by said method is at least five fold lower when compared to a liquid product produced by an identical method processing a feedstock in the absence of a calcium containing compound.

36. A method of reducing the hydrogen sulfide content of a product stream from upgrading a heavy hydrocarbon feedstock, comprising:

(i) rapid thermal processing of the heavy hydrocarbon feedstock in the presence of a calcium compound and optionally in the presence of water, the rapid thermal processing comprises allowing the heavy hydrocarbon feedstock to interact with a particulate heat carrier in an upflow reactor run at a temperature in the range from 450° C. to 600° C. for less than 5 seconds, to produce the product stream, and the ratio of the particulate heat carrier to the heavy hydrocarbon feedstock is from 10:1 to 200:1;

(ii) regenerating the particulate heat carrier in a reheater to form a regenerated particulate heat carrier, in the presence of the calcium compound; and (iii) recycling the regenerated particulate heat carrier to the upflow reactor; wherein:

a) the particulate heat carrier is different from the calcium compound; and b) the amount of the calcium compound added to the heavy hydrocarbon feedstock is from about 0.2 to about 5 fold the stoichiometric amount of sulfur in said feedstock.

37. The method of claim 36, wherein the sulfur-based gas emissions is at least 85% lower than that produced by an identical method in the absence of a calcium containing compound.

38. The method of claim 36, wherein the heavy hydrocarbon feedstock is:

1) a high TAN value, low sulfur content heavy hydrocarbon feedstock;

2) a low TAN value, high sulfur content heavy hydrocarbon feedstock; or 3) a high TAN value, high sulfur content heavy hydrocarbon feedstock.

39. The method of claim 36, wherein the calcium compound is selected from $Ca(OH)_2$, CaO, and $CaCO_3$.

40. The method of claim 36, wherein the amount of the calcium compound required to lower the level of sulfur-based gas emissions is reduced.

41. The method of claim 36, wherein the TAN value of the liquid product produced by said method is at least five fold lower when compared to a liquid product produced by an identical method processing a feedstock in the absence of a calcium containing compound.

42. A method of reducing the hydrogen sulfide content of a product stream from upgrading a heavy hydrocarbon feedstock, comprising:

(i) rapid thermal processing of the heavy hydrocarbon feedstock in the presence of a calcium compound, the rapid thermal processing comprises allowing the heavy hydrocarbon feedstock to interact with a particulate heat carrier in an upflow reactor run at a temperature in the range from 450° C. to 600° C. for less than 5 seconds, to produce a product stream, and the ratio of the particulate heat carrier to the heavy hydrocarbon feedstock is from 10:1 to 200:1;

(ii) regenerating the particulate heat carrier in a reheater to form a regenerated particulate heat carrier, in the presence of the calcium compound; and (iii) recycling the regenerated particulate heat carrier to the upflow reactor; wherein:

a) the particulate heat carrier is sand; and b) the amount of the calcium compound added to the heavy hydrocarbon feedstock is from about 0.2 to about 5 fold the stoichiometric amount of sulfur in said feedstock.

43. The method of claim 42, wherein prior to said rapid thermal processing the heavy hydrocarbon feedstock:

(i) treating the heavy hydrocarbon feedstock with the calcium compound, and (ii) introducing said treated feedstock to the upflow reactor.

44. The method of claim 42, wherein the TAN value of the treated heavy hydrocarbon feedstock is at least three fold lower when compared to an identical heavy hydrocarbon feedstock untreated by a calcium containing compound.

45. The method of claim 42, wherein the size of the particulate heat carrier is greater than the size of the calcium compound.

46. The method of claim 42, wherein the reduction of the sulfur-based gas emissions is at least 90% lower than that produced by an identical method in the absence of a calcium containing compound.

47. A method of reducing the amount of calcium compound required to reduce the hydrogen sulfide content of a product stream from upgrading a heavy hydrocarbon feedstock, comprising:

(i) rapid thermal processing of the heavy hydrocarbon feedstock in the presence of a fine powder calcium compound, the rapid thermal processing comprises allowing the heavy hydrocarbon feedstock to interact with a particulate heat carrier in an upflow reactor run at a temperature in the range from 450° C. to 600° C. for less than 5 seconds, to produce a product stream, and the ratio of the particulate heat carrier to the heavy hydrocarbon feedstock is from 10:1 to 200:1;

(ii) regenerating the particulate heat carrier in a reheater to form a regenerated particulate heat carrier, in the presence of the fine powder calcium compound; and (iii) recycling the regenerated particulate heat carrier to the upflow reactor; wherein:

a) the particulate heat carrier is different from the fine powder calcium compound;

b) the amount of the fine powder calcium compound added to the heavy hydrocarbon feedstock is from about 0.2 to about 5 fold the stoichiometric amount of sulfur in said feedstock; and c) the reduction of the sulfur emissions is at least 85% lower than that produced by an identical method in the absence of a calcium containing compound.

48. The method of claim 47, wherein the calcium compound is $Ca(OH)_2$.

49. The method of claim 47, wherein the particulate heat carrier is sand.

50. The method of claim 47, wherein the size of the particulate heat carrier is greater than the size of the calcium compound.

51. A method of reducing the hydrogen sulfide content of a product stream from upgrading a heavy hydrocarbon feedstock, comprising:

(i) treating the heavy hydrocarbon feedstock with $Ca(OH)_2$;

(ii) introducing said treated feedstock to an upflow reactor;

(iii) rapid thermal processing of the treated feedstock, in the presence of the $Ca(OH)_2$, the rapid thermal processing comprises allowing the treated feedstock to interact with a particulate heat carrier in the upflow reactor run at a temperature in the reactor from 450° C. to 600° C. for less than 5 seconds, to produce a product stream, and the ratio of the particulate heat carrier to the heavy hydrocarbon feedstock is from 10:1 to 200:1;

(iv) regenerating the particulate heat carrier in a reheater to form a regenerated particulate heat carrier, in the presence of the $Ca(OH)_2$; and (v) recycling the regenerated particulate heat carrier to the upflow reactor; wherein:

(a) the $Ca(OH)_2$ is added to the reheater;

(b) the particulate heat carrier is sand; and (c) the amount of the $Ca(OH)_2$ added to the heavy hydrocarbon feedstock is from about 0.2 to about 5 fold the stoichiometric amount of sulfur in said feedstock.

52. The method of claim 51, wherein the TAN value of the treated heavy hydrocarbon feedstock is at least three fold lower when compared to an identical heavy hydrocarbon feedstock untreated by a calcium containing compound.

53. The method of claim 51, wherein up to 5 wt. % water, relative to the weight of the heavy hydrocarbon feedstock, is present.

54. The method of claim 51, wherein the reduction of the sulfur-based gas emissions is at least 95% lower than that produced by an identical method in the absence of a calcium containing compound.

55. The method of claim 51, wherein the TAN value of the liquid product produced by said method is at least five fold lower when compared to a liquid product produced by an identical method processing a feedstock in the absence of a calcium containing compound.

* * * * *